US009305475B2

(12) United States Patent
White

(10) Patent No.: US 9,305,475 B2
(45) **Date of Patent: *Apr. 5, 2016**

(54) MULTIPURPOSE SIGN BASES FOR SUPPORTING TEMPORARY ROADWAY SAFETY SIGNS

(71) Applicant: Franklin B White, Ft. Pierce, FL (US)

(72) Inventor: Franklin B White, Ft. Pierce, FL (US)

(73) Assignee: J. E. WHITE, LLC, Ft. Pierce, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/987,383

(22) Filed: Jul. 19, 2013

(65) Prior Publication Data

US 2015/0023009 A1 Jan. 22, 2015

Related U.S. Application Data

(63) Continuation of application No. 12/802,191, filed on Jun. 1, 2010, now Pat. No. 8,590,190.

(60) Provisional application No. 61/340,760, filed on Mar. 22, 2010.

(51) Int. Cl.

| | |
|---|---|
| ***G09F 7/00*** | (2006.01) |
| ***G09F 21/04*** | (2006.01) |
| ***F21L 4/02*** | (2006.01) |
| ***F21L 4/08*** | (2006.01) |
| ***G09F 15/00*** | (2006.01) |
| *G09F 7/18* | (2006.01) |

(52) U.S. Cl.

CPC . *G09F 21/04* (2013.01); *F21L 4/02* (2013.01); *F21L 4/08* (2013.01); *G09F 15/0062* (2013.01); *G09F 15/0075* (2013.01); *G09F 2007/1865* (2013.01)

(58) Field of Classification Search

CPC ..... G09F 2007/1865; G09F 2007/1878; E01F 9/011; E01F 9/0114; E01F 9/019; E01F 9/0182; E01F 9/018; E01F 9/0126

See application file for complete search history.

(56) References Cited

U.S. PATENT DOCUMENTS

| | | | | |
|---|---|---|---|---|
| 1,443,247 | A | 1/1923 | Wrightman | 40/607.11 |
| 2,514,434 | A | 2/1951 | Leonard et al. | 248/210 |
| 2,655,748 | A | 10/1953 | Hirt | 40/612 |
| D183,569 | S | 9/1958 | Hoffman | D10/109.1 |

(Continued)

OTHER PUBLICATIONS

Newman traffic signs mounting hardware, 2008, 1 page http://www.newmansigns.com/traffic_signs/accessories.php.

(Continued)

*Primary Examiner* — Kristina Junge
(74) *Attorney, Agent, or Firm* — David A. Burge

(57) ABSTRACT

A multipurpose sign base suitable for supporting temporary signs includes an upstanding mast supportable atop a support surface by a substantially horizontally extending, elongate, support member connected to a lower region of the mast, and by a plurality of elongate leg members of adjustable length each having an upper portion movably connected to a central region of the mast, and each having a lower portion movably connected to a different foot adapted to engage a different area of the support surface at locations arrayed about the mast. An upper region of the mast is connectable to a sign to support and display the sign. The legs and feet have retracted positions near the mast. A rearwardly extending formation of the horizontal support member can be coupled to a vehicle hitch so the sign base also can be supported on a vehicle for transport while displaying a sign.

7 Claims, 19 Drawing Sheets

(56) References Cited

U.S. PATENT DOCUMENTS

| | | | | |
|---|---|---|---|---|
| 3,355,998 | A | 12/1967 | Roemisch | 403/2 |
| 3,381,427 | A | 5/1968 | Watson | 52/98 |
| 3,620,496 | A | 11/1971 | Bolt | 248/171 |
| 3,622,980 | A | 11/1971 | Elledge | 315/323 |
| 3,677,511 | A | 7/1972 | Dicke | 248/448 |
| 3,702,033 | A | 11/1972 | Coleman | 40/541 |
| 3,752,476 | A | 8/1973 | Mahoney | 273/1.5 |
| 3,798,814 | A | 3/1974 | Harmon | 40/590 |
| 3,820,906 | A | 6/1974 | Katt | 403/2 |
| 3,899,843 | A | 8/1975 | Doyle et al. | 40/125 |
| 3,912,404 | A | 10/1975 | Katt | 403/2 |
| D241,539 | S | 9/1976 | Iverson | D20/22 |
| D248,910 | S | 8/1978 | DeFilippo | D6/137 |
| 4,134,222 | A | 1/1979 | Orsos | 40/606.15 |
| 4,249,832 | A | 2/1981 | Schmanski | 404/6 |
| 4,288,053 | A | 9/1981 | Sarkisian | 248/218.4 |
| 4,309,836 | A | 1/1982 | Knapp | 40/602 |
| 4,338,041 | A | 7/1982 | Schmanski | 404/9 |
| 4,347,932 | A | 9/1982 | Furutu | 206/343 |
| 4,433,935 | A | 2/1984 | Main et al. | 403/385 |
| 4,498,657 | A | 2/1985 | Werner | 248/623 |
| 4,507,887 | A | 4/1985 | Seely | 40/606 |
| 4,548,379 | A | 10/1985 | Seely et al. | 248/624 |
| 4,569,499 | A | 2/1986 | Seely | 248/624 |
| 4,572,473 | A | 2/1986 | Seely | 248/624 |
| 4,575,040 | A | 3/1986 | Seely | 248/624 |
| 4,592,158 | A | 6/1986 | Seely | 40/603 |
| 4,593,265 | A | 6/1986 | McKenney | 340/908.1 |
| 4,593,879 | A | 6/1986 | Seely et al. | 248/624 |
| D286,166 | S | 10/1986 | Russell | D20/22 |
| D288,282 | S | 2/1987 | Sheets | D8/373 |
| D290,931 | S | 7/1987 | Powell | D8/373 |
| D296,075 | S | 6/1988 | Jones | D8/373 |
| D306,690 | S | 3/1990 | Bison | D8/382 |
| 4,928,446 | A | 5/1990 | Alexander, Sr. | 52/98 |
| 5,015,119 | A | 5/1991 | Schmanski | 404/12 |
| D321,914 | S | 11/1991 | Tam | D20/43 |
| 5,094,023 | A | 3/1992 | McVey | 40/606 |
| D329,372 | S | 9/1992 | Wilms | D8/380 |
| D330,523 | S | 10/1992 | Killion | D10/119.2 |
| D334,815 | S | 4/1993 | Bunger | D25/113 |
| 5,208,585 | A | 5/1993 | Sprague | 340/908.1 |
| 5,231,393 | A | 7/1993 | Strickland | 340/936 |
| D337,912 | S | 8/1993 | Silverberg | D6/567 |
| 5,244,172 | A | 9/1993 | Allega | 248/161 |
| D342,011 | S | 12/1993 | Maguire | D8/349 |
| D344,764 | S | 3/1994 | Tam | D20/43 |
| 5,318,258 | A | 6/1994 | Lang | 248/166 |
| 5,340,068 | A | 8/1994 | Sarkisian et al. | 248/188.6 |
| D353,627 | S | 12/1994 | McCormick | D20/43 |
| D354,773 | S | 1/1995 | Koves | D19/99 |
| 5,422,638 | A | 6/1995 | Singer et al. | 340/908.1 |
| 5,446,984 | A | 9/1995 | Kulp et al. | 40/610 |
| D369,958 | S | 5/1996 | Huang et al. | D8/387 |
| D370,171 | S | 5/1996 | Emerson | D8/354 |
| D373,074 | S | 8/1996 | Miyashita | D8/382 |
| 5,542,203 | A | 8/1996 | Luoma et al. | 40/610 |
| D374,811 | S | 10/1996 | Miyashita | D8/382 |
| D377,751 | S | 2/1997 | Koebbe | D8/355 |
| 5,619,829 | A | 4/1997 | Tan et al. | 52/293.3 |
| 5,675,923 | A | 10/1997 | Sarkisian et al. | 40/612 |
| D389,078 | S | 1/1998 | Freeman | D10/113.2 |
| D393,045 | S | 3/1998 | Hsu | D20/43 |
| 5,725,186 | A | 3/1998 | Hillstrom et al. | 248/176.1 |
| D400,428 | S | 11/1998 | Sabounjian | D8/382 |
| D401,211 | S | 11/1998 | Simpson | D12/223 |
| 5,829,178 | A | 11/1998 | Hillstrom | 40/610 |
| 5,878,519 | A | 3/1999 | Huyck, Jr. et al. | 40/612 |
| 5,906,064 | A | 5/1999 | Field | 40/606 |
| D416,290 | S | 11/1999 | Poelvoorde et al. | D20/43 |
| 5,979,094 | A | 11/1999 | Brafford, Jr. | 40/590 |
| 6,003,827 | A | 12/1999 | Kulp et al. | 248/534 |
| D420,566 | S | 2/2000 | Ely et al. | D8/359 |
| D425,133 | S | 5/2000 | Ueno | D20/43 |
| D428,804 | S | 8/2000 | Benz et al. | D8/382 |
| 6,101,750 | A | 8/2000 | Blesener et al. | 40/448 |
| 6,107,941 | A | 8/2000 | Jones | 340/915 |
| D430,789 | S | 9/2000 | Opperman | D8/363 |
| 6,113,055 | A | 9/2000 | Salman | 248/548 |
| 6,119,384 | A | 9/2000 | Fischer | 40/606.02 |
| 6,237,268 | B1 | 5/2001 | Levin | 40/606 |
| 6,237,883 | B1 | 5/2001 | Levin et al. | 248/176.1 |
| 6,308,927 | B1 | 10/2001 | Leahy | 248/548 |
| 6,378,232 | B1 | 4/2002 | Creech | 40/611 |
| 6,378,818 | B1 | 4/2002 | Padiak et al. | 248/201 |
| 6,430,855 | B1 | 8/2002 | Gertz et al. | 40/607 |
| D464,013 | S | 10/2002 | Adams et al. | D12/223 |
| 6,463,687 | B1 | 10/2002 | Dorstewitz | 40/610 |
| D474,676 | S | 5/2003 | Bainbridge | D8/354 |
| 6,560,906 | B1 | 5/2003 | Hillstrom | 40/606 |
| 6,622,408 | B2 | 9/2003 | Dicke et al. | 40/610 |
| 6,622,409 | B2 | 9/2003 | Dorstewitz | 40/610 |
| 6,625,912 | B2 | 9/2003 | Dicke et al. | 40/610 |
| D483,249 | S | 12/2003 | Klein et al. | D8/373 |
| 6,685,156 | B2 | 2/2004 | Dicke et al. | 248/624 |
| 6,695,266 | B1 | 2/2004 | Tsai | 248/125.8 |
| D488,056 | S | 4/2004 | Dion | D8/381 |
| 6,734,792 | B1 | 5/2004 | McElveen | 340/468 |
| D491,450 | S | 6/2004 | Braun et al. | D8/382 |
| 6,750,829 | B2 | 6/2004 | Lumona et al. | 345/1.1 |
| 6,755,381 | B1 | 6/2004 | Levin et al. | 248/163.1 |
| D494,050 | S | 8/2004 | Klein et al. | D8/373 |
| D494,454 | S | 8/2004 | Klein et al. | D8/373 |
| 6,792,708 | B2 | 9/2004 | Dicke et al. | 40/610 |
| 6,793,191 | B1 | 9/2004 | Williams et al. | 248/624 |
| D507,226 | S | 7/2005 | Oksa | D12/223 |
| D507,352 | S | 7/2005 | Vanderbrugghen | D25/42 |
| D508,572 | S | 8/2005 | Suggate | D25/134 |
| 6,962,461 | B2 | 11/2005 | Choi et al. | 404/6 |
| D520,322 | S | 5/2006 | Orlando | D8/70 |
| 7,069,680 | B1 | 7/2006 | Crawford | 40/607.14 |
| 7,171,773 | B2 | 2/2007 | Haggard, Jr. | 40/591 |
| D541,636 | S | 5/2007 | Walker et al. | D8/373 |
| D547,462 | S | 7/2007 | Petta et al. | D25/122 |
| D552,947 | S | 10/2007 | Ewasiuk | D8/5 |
| D557,344 | S | 12/2007 | Johnson | D20/41 |
| D558,274 | S | 12/2007 | Geeves | D20/41 |
| D559,665 | S | 1/2008 | Terada et al. | D8/382 |
| D563,776 | S | 3/2008 | Dagg | D8/382 |
| D564,868 | S | 3/2008 | Terada et al. | D8/382 |
| D567,635 | S | 4/2008 | Nankervis | D8/354 |
| D571,645 | S | 6/2008 | Skoog | D8/382 |
| 7,398,952 | B2 | 7/2008 | Carnevali | 248/404 |
| D576,026 | S | 9/2008 | Mazzocco | D8/382 |
| D583,219 | S | 12/2008 | Dagg | D8/349 |
| 7,458,554 | B1 | 12/2008 | Levin et al. | 248/408 |
| 7,503,135 | B2 | 3/2009 | Chafin | 40/591 |
| D591,586 | S | 5/2009 | Dagg | D8/382 |
| D599,649 | S | 9/2009 | Wakasugi et al. | D8/382 |
| 7,594,633 | B2 | 9/2009 | Carnevali | 248/404 |
| D605,497 | S | 12/2009 | Lulla et al. | D8/354 |
| D609,752 | S | 2/2010 | Miller | D20/41 |
| D611,887 | S | 3/2010 | Peschmann | D12/223 |
| D617,180 | S | 6/2010 | VanElverdinghe | D8/382 |
| D617,633 | S | 6/2010 | VanElverdinghe | D8/382 |
| 7,780,323 | B2 | 8/2010 | Nolle | 362/540 |
| D623,697 | S | 9/2010 | Makhija et al. | D20/41 |
| D627,630 | S | 11/2010 | Sandinge | D8/380 |
| D631,734 | S | 2/2011 | Fernandez et al. | D8/380 |
| D638,694 | S | 5/2011 | Misch | D8/380 |
| 7,997,547 | B1 | 8/2011 | Maus | 248/219.3 |
| 8,001,880 | B2 | 8/2011 | White et al. | 89/36.04 |
| 8,038,126 | B1 | 10/2011 | Albritton | 256/13.1 |
| D650,126 | S | 12/2011 | Kong et al. | D26/138 |
| D665,656 | S | 8/2012 | Anzelmo | D8/380 |
| D669,135 | S | 10/2012 | Garfinkle | D20/43 |
| D678,045 | S | 3/2013 | Paolini | D8/382 |
| D679,336 | S | 4/2013 | White | D20/41 |
| D692,498 | S | 10/2013 | Valls et al. | D20/43 |
| D701,107 | S | 3/2014 | White | D8/354 |
| D703,029 | S | 4/2014 | Fox | D8/373 |
| 8,726,552 | B2 | 5/2014 | Larsen | 40/591 |
| D707,545 | S | 6/2014 | Schopf | D8/394 |
| D713,463 | S | 9/2014 | Dougherty et al. | D20/43 |

(56) References Cited

U.S. PATENT DOCUMENTS

| | | | | |
|---|---|---|---|---|
| D727,138 | S | 4/2015 | Cross | D8/382 |
| D730,719 | S | 6/2015 | Sundberg | D8/354 |
| D730,724 | S | 6/2015 | Brown | D8/380 |
| D732,380 | S | 6/2015 | Chou | D8/383 |
| 2002/0174582 | A1 | 11/2002 | Garfinkle et al. | 40/606 |
| 2005/0269466 | A1 | 12/2005 | Conway et al. | 248/222.14 |
| 2008/0006746 | A1* | 1/2008 | Volochine | 248/169 |
| 2008/0178506 | A1 | 7/2008 | Garfinkle | 40/658 |
| 2008/0307684 | A1 | 12/2008 | Ulloa et al. | 40/607.1 |
| 2009/0178319 | A1 | 7/2009 | Ulloa et al. | 40/607.1 |
| 2009/0289161 | A1 | 11/2009 | Nuttman | 248/229.1 |
| 2010/0012811 | A1 | 1/2010 | MacKenzie et al. | 248/423 |
| 2010/0109910 | A1 | 5/2010 | Fahey | 340/908 |
| 2011/0010974 | A1 | 1/2011 | White | 40/606.02 |
| 2011/0012751 | A1 | 1/2011 | Jones | 340/825.69 |
| 2011/0047845 | A1 | 3/2011 | Barile | 40/658 |
| 2011/0214321 | A1 | 9/2011 | White | 40/606.01 |
| 2012/0001051 | A1 | 1/2012 | Williams | 248/519 |
| 2012/0204454 | A1 | 8/2012 | Larsen | 40/591 |
| 2012/0285567 | A1 | 11/2012 | Kessler | 137/615 |
| 2013/0161943 | A1 | 6/2013 | Bailey | 285/283 |

OTHER PUBLICATIONS

Western Safety Products Sign Mounting Hardware & Posts, 2015, 2 Pages http://www.westernsafety.com/products/safewaysigns/safewaysignpg4.html.

Safetysign.com website 180 Degree U-Channel Post Bkt , 2015, 1 page http://www,safetysign.com/products/p8863/street-name-bracket.

Grimco Inc. U Channel Post Bracket Heavy Duty St. Sign, 2015, 1 pagehttp://www.grimco.com/Products.aspx?cid+0073&pid=00318&sid-BA180F.

Traffic Sign Source website 180X U-channel Post Bkt, 2015, 1 page http://www.trafficsignsource.com/signhardware.htm.

* cited by examiner

MULTIPURPOSE SIGN BASES FOR SUPPORTING TEMPORARY ROADWAY SAFETY SIGNS

REFERENCE TO RELATED APPLICATIONS

This is a Continuation of U.S. Utility application Ser. No. 12/802,191 filed Jun. 1, 2010 by Franklin B. White entitled MULTIPURPOSE SIGN BASES FOR SUPPORTING TEMPORARY ROADWAY SAFETY SIGNS, issued (Nov. 26, 2013) as U.S. Patent No. (8,590,190), referred to herein as the Original Utility Application, the disclosure of which is incorporated herein by reference.

The Original Utility application referenced just above claimed filing date benefit of Provisional Application Ser. No. 61/340,760 filed Mar. 22, 2010 by Franklin B. White entitled MULTIPURPOSE SIGN BASES FOR TEMPORARY ROADWAY SAFETY SIGNS, the disclosure of which is incorporated herein by reference.

BACKGROUND

The present invention relates to temporary roadway safety sign support devices, known as "sign bases," and, more particularly, to sign bases that are well suited to temporarily support roadway safety signs which warn, caution and inform approaching motorists of construction zones and sites that may require the prompt adoption of special driving precautions to ensure the safety of road workers as well as travelers and others who are in the vicinities of the zones and sites where roadway safety signs are posted. Sign bases embodying features of the invention also may be used to support signs of many other types, and are therefore multipurpose in character.

Because temporary zones of roadway construction and repair are now quite prevalent throughout the United States and Canada, and because these zones of temporary activity need to be clearly, legibly and reliably marked to warn and inform approaching roadway travelers of essential precautions to be taken, diminished speed limits to be observed, and the like, temporarily posted roadway safety signs have come to play a significant role in roadway travel.

What is meant herein by the term "roadway" includes suburban streets, avenues and boulevards; rural, county, and state roads, highways, tollways, expressways, junctions, interchanges, underpasses and overpasses; and all other types of paved and unpaved routes and route components that are used by motorized and non-motorized roadway vehicles, farm equipment and the like as well as animal-drawn buggies, wagons, carriages and equipment, including all other forms of conveyance used by persons engaged in roadway travel.

What is meant herein by the term "safety sign" includes signs used to convey messages of warning and caution, and advising of roadway detours, hazards and other noteworthy conditions, or simply conveying general information of a useful nature that is desirably brought to the attention of roadway travelers, and the like.

It is important that today's temporarily installable roadway safety sign bases be capable of being quickly and easily erected, taken down, moved between installation sites, and reinstalled time after time atop various forms of underlying ground or support surface. What is meant herein by either of the terms "ground surface" and "support surface" is any roadway or terrain surface or the like atop which a roadway safety sign or the like may need to be temporarily supported and displayed, including but not limited to surfaces that are paved, unpaved, flat, irregular, pitted, sloping, wet, dry, soft or solid, and that may exhibit combinations of these and other variable characteristics.

It is equally important that the sign bases be capable of reliably supporting and safely displaying roadway safety signs in a stable and legible manner wherever the signs need to be posted, regardless of attendant conditions of high wind and inclement weather that may bring snow, rain, sleet, coatings of ice, and the like, and regardless of such forces as may be imposed from time to time on the signs and sign bases due to the passage nearby of heavy trucks, other roadway vehicles, and the like.

Today's temporarily installable sign bases also need to be capable of adjusting the height at which they support roadway safety signs to comply with requirements that differ among state and federal jurisdictions. And, to facilitate movement between installation sites, it is important that the extensible and retractable components of today's temporarily installable sign bases be collapsible into compact forms capable of being easily loaded onto or attached to vehicles for transport, or both.

Because strained budgets have diminished the sizes of road crews, it has become increasingly important that today's sign bases used to temporarily support roadway safety signs be constructed from well engineered sets of relatively lightweight components that interact efficiently to provide stable, safe and reliable support to roadway safety signs, while also being capable of being quickly and easily erected, taken down and manipulated, as necessary, by progressively smaller road crews and, in many instances, by individual roadway workers.

Although a few proposed sign bases have been designed to be connected to and supported by hitches located at the rear of vehicles such as pickup trucks, no proposed sign bases are known that are well suited to be vehicle hitch supportable as well as ground surface supportable, so the resulting sign bases can operably support roadway safety signs not only from vehicle hitches, but also in free standing modes atop paved and unpaved ground surfaces regardless of surface irregularities and slope.

No temporarily installable sign bases are known that are designed to support roadway safety signs alternatively by connection to a vehicle hitch, or from footed legs of adjustable length that also provide a built-in capability to securely connect to a support surface by penetrating support surface portions that underlie the leg-carried feet as they rest atop the support surface.

Nor are temporarily installable multipurpose sign bases known that employ one or more "gas springs" to store energy as relatively movable mast components are retracted during the lowering of a roadway safety sign so the stored energy can be used when the relatively movable mast components are extended to assist with the raising of the roadway safety sign; or sign bases that have removably connectable wheeled dollies enabling the bases to be moved easily about on ground surfaces near installation sites.

SUMMARY

In some embodiments, the present invention provides a multipurpose sign base for supporting a roadway safety sign or the like, wherein the sign base has an upstanding mast supportable atop a ground surface by a substantially horizontally extending, elongate, ground engageable member connected to a lower region of the mast, and by a plurality of elongate leg members of adjustable length each having an upper portion movably connected to a central region of the mast, and each having a lower portion movably connected to a different ground engageable foot, with an upper region of the mast being adapted for connection to a roadway safety sign to support and display the roadway safety sign.

In some embodiments, the horizontal support members of multipurpose sign bases such as are described just above cooperate with feet pivotally connected to lower end regions of the leg members to ensure that ground surfaces underlying the sign bases are engaged at several spaced locations arrayed about lower end regions of the upstanding masts to ensure that the sign bases provide stable and secure support to the signs they carry and display.

In some embodiments, a multipurpose sign base for supporting a roadway safety sign has an upstanding mast that includes at least an upper mast component and a lower mast component that are telescopically extensible and retractable, and that have a gas spring interposed between the upper and lower mast components, with the gas spring being operable to assist in raising the upper mast component relative to the lower mast component by utilizing energy stored by the gas spring when the upper mast component is lowered relative to the lower mast component. In preferred practice, the gas springs are protectively enclosed within the telescopically movable upper and lower mast components that are served by the gas springs.

In some embodiments, a multipurpose sign base has an upstanding support mast connected to a retractable set of legs that can be moved from extended positions engageable with an underlying ground surface for supporting the sign base atop the underlying ground surface to retracted positions extending near a lower region of the support mast, and has a hitch-housing-connectable formation connected to the mast for connecting the sign base to a hitch housing of an over-the-road vehicle for supporting the mast from the vehicle's hitch housing as an alternative to supporting the mast from the legs of the sign base when feet carried by the legs engage an underlying ground surface. In such embodiments, the hitch-housing-connectable formation may be defined by a rear portion of a horizontally extending support member of the sign base, or by an extension component telescopically carried by the horizontally extending support member that permits the sign base to be carried at an adjustable distance behind the vehicle's hitch housing, so a pickup truck's tailgate can be operated without being obstructed by the sign base that is connected to the vehicle's hitch housing.

In some embodiments, a multipurpose sign base has an extensible and retractable upright mast having an upper component and a lower component that are relatively movable, and has a plurality of legs pivotally connected to the lower component for supporting the mast atop an underlying ground surface, with the length of at least a selected one of the legs being adjustable to enable the legs to support the mast in a substantially vertical orientation, and with the selected one of the legs not only having an associated foot formation movably connected to the leg for engaging a portion of the underlying ground surface, but also carrying a spike member that can extend telescopically beneath the associated foot formation to penetrate the underlying ground surface portion. In embodiments of this type, preferably all of the legs are provided with movably connected foot formations equipped with spike members to enable any or all of the legs to be securely connected to underlying ground surface portions.

In some embodiments, a multipurpose sign base has an upstanding mast with an upper region attachable to a roadway safety sign, has a lower region to which a substantially horizontally extending, elongate support member is attached that carries a foot formation for engaging a support surface in a first area of contact, and has three elongate, telescopically extensible legs with upper end portions pivotally connected to a central region of the upstanding mast for pivoting between retracted positions near the lower region of the mast, and extended positions wherein foot formations carried by lower portions of each of the three legs engage the support surface at second, third and fourth areas of contact arrayed about the mast for supporting the upstanding mast in a substantially vertical orientation atop the support surface.

In embodiments of the multipurpose sign base that have feet movably connected to lower end regions of retractable-extensible legs, a tray is preferably provided near the lower end of the mast to support at least some of the feet when the legs are moved to retracted positions near the mast.

Some of the above-described embodiments may include one or more wheeled dollies that are removably connectable to horizontally extending support components of the sign bases to facilitate moving the sign bases atop support surfaces.

Some of the above-described embodiments may be provided with tubular components having adjacent open end regions that are held in alignment and connected by structurally weakened metal blocks extending into the open end regions to provide breakaway safety connections designed to sever in the event the sign base, or a sign carried by the sign base, is struck by a moving object such as a motor vehicle.

Some of the above-described sign base embodiments may support roadway safety signs that carry a plurality of lights powered by a battery supported by the sign base, or alternatively by a wiring harness of the sign base that can be electrically connected to an electrical system of a vehicle to which the sign base may be attached when desired. Some of these embodiments may also include a control carried by the mast of the sign base that can be operated to cause at least selected ones of the lights to flash in sequences selected by setting the control. And, some of these embodiments may include a solar panel adjustably supported by the mast for charging the battery.

Some of the above-described embodiments may be be designed for use with large metal signs, or may be designed for use with large fabric signs through which air can easily flow, thereby diminishing the weight the sign bases must carry and the wind loads the sign bases must withstand. Some embodiments may be designed for use with both metal and fabric signs, either or both of which may carry strobe lights or lights designed to provide flashing arrows or other types of illuminated displays.

These and other features will be more fully understood by referring to the accompanying drawings and the detailed description that follows, taken together with the example claims that follow the detailed description.

DETAILED DESCRIPTION

Figure 1:
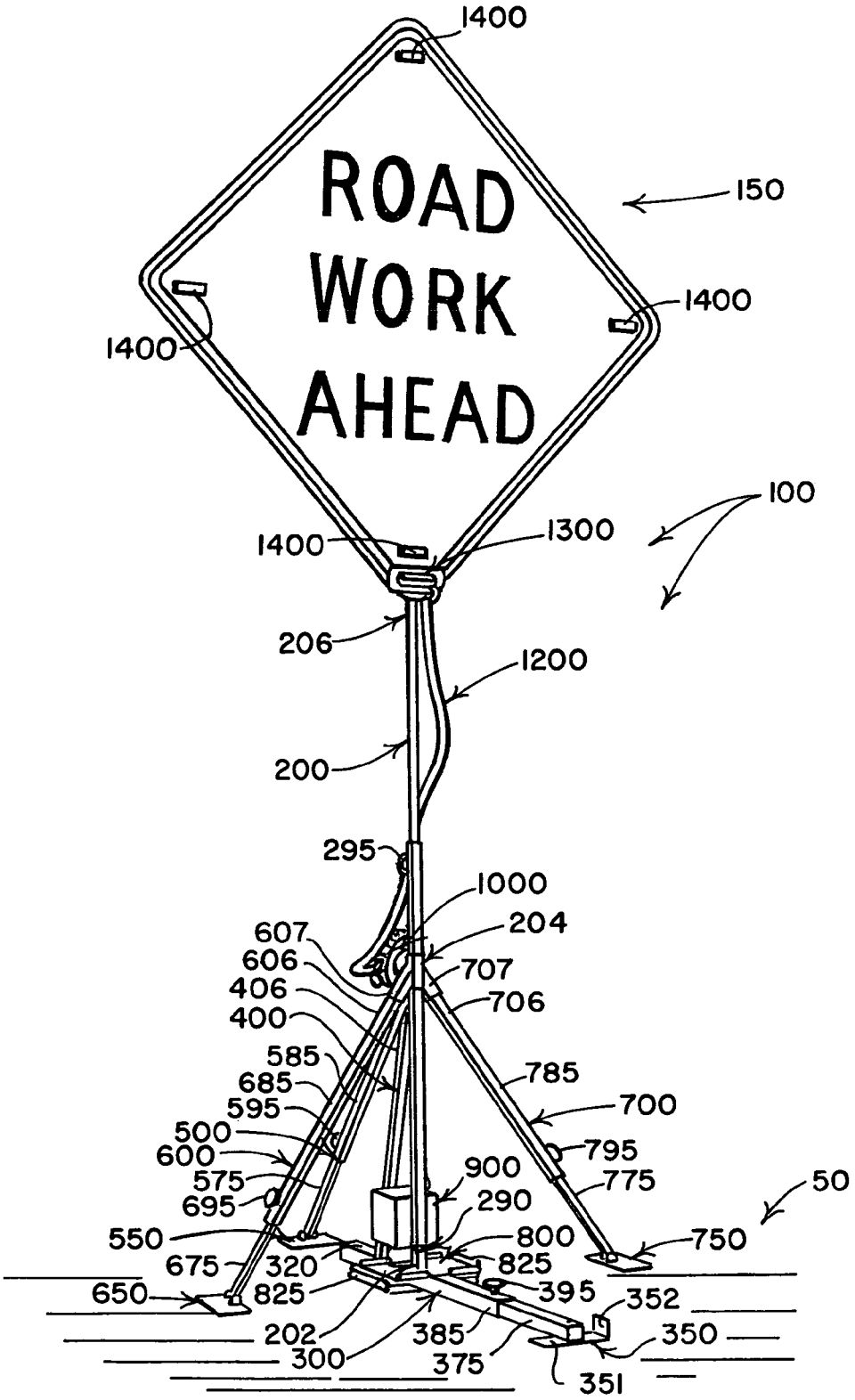
FIG. 1 is a perspective view of a multipurpose sign base with legs of the sign base extended to engage an underlying support surface, with a mast of the sign base extended and supporting a roadway safety sign in a raised position, with a wiring harness of the sign base extending along the mast to power lights carried on the sign and on the mast from a battery carried in a battery box near the base of the mast as directed by a control box carried at a mid-height location along the mast, and with the view showing principally front and left side features of the sign base and sign.
Figure 2:
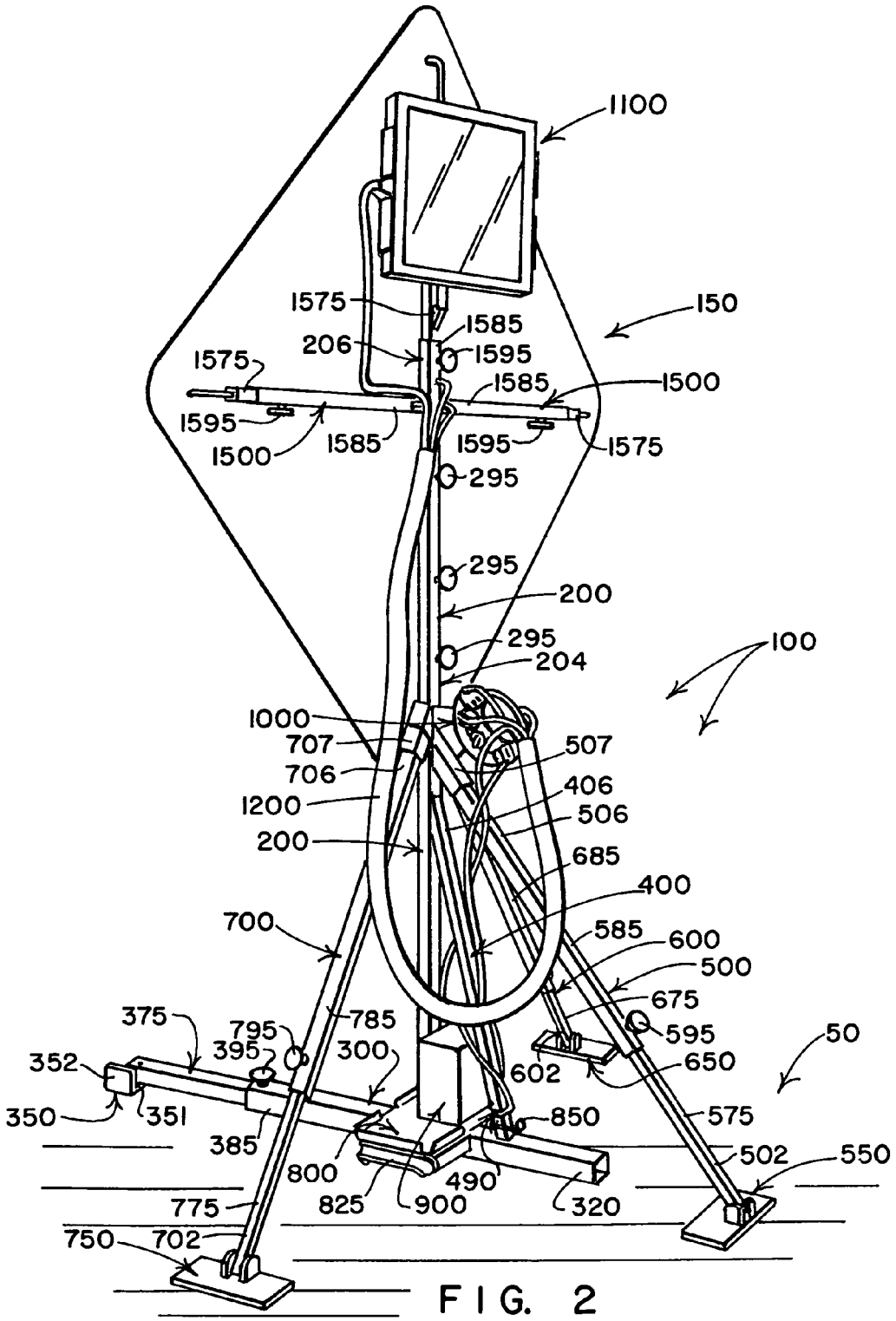
FIG. 2 is a perspective view on a larger scale of the sign base and sign, with the legs of the sign base extended to enable feet carried by the legs to engage the underlying support surface, with the mast of the sign base retracted and supporting the sign in a lowered position, with an upper portion of the wiring harness lowered to form a loop extending from the control box to the sign, and with the view depicting principally rear and right side features of the sign base and sign.
Figure 3:
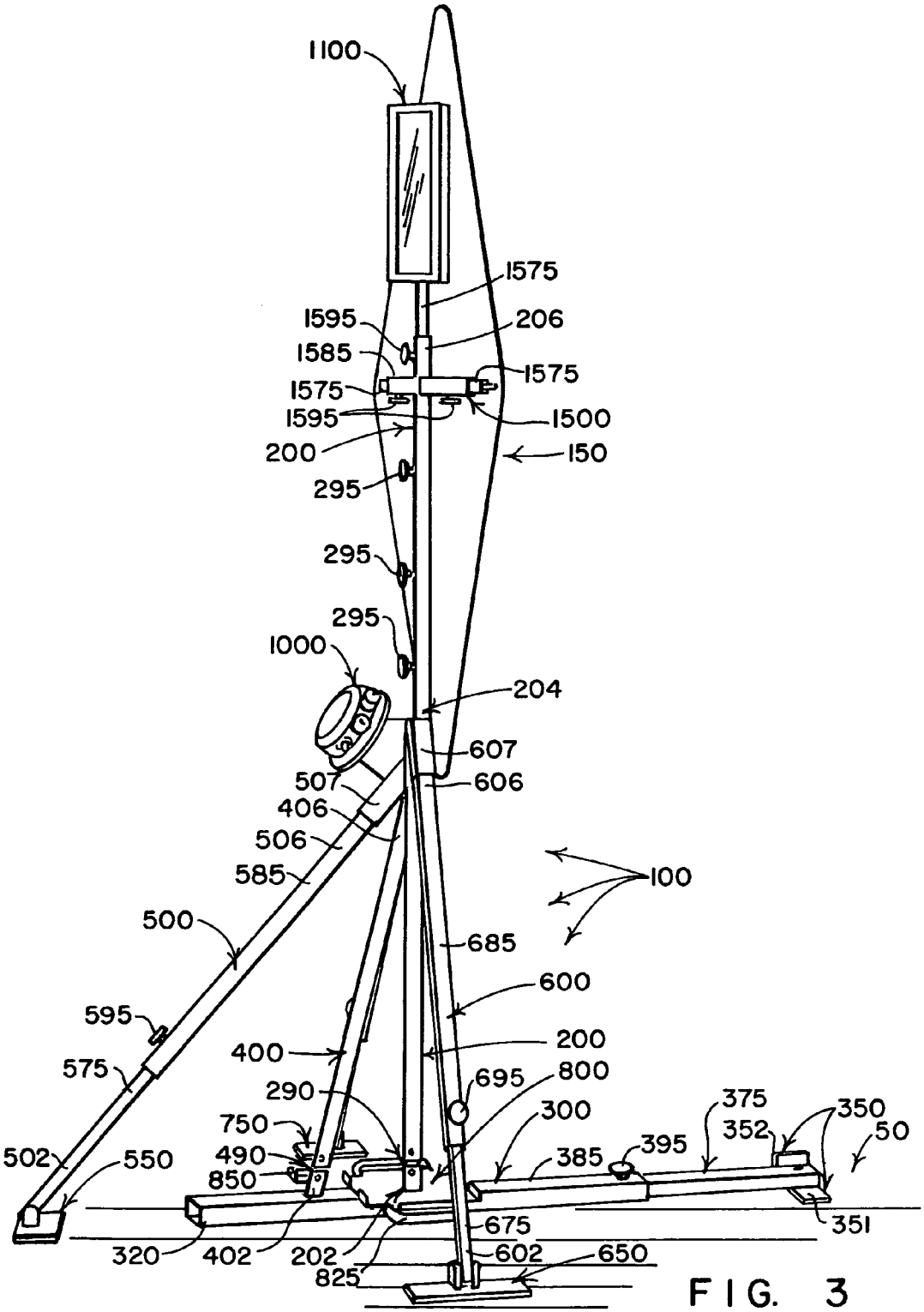
FIG. 3 is a perspective view of the sign base and sign with the sign in the lowered position of FIG. 2, with the legs extended and the feet engaging an underlying ground surface, with the wiring harness and battery box of the sign base removed to permit other components to be viewed more clearly, and with the view showing mainly rear and left side features of the sign base and sign.
Figure 30:
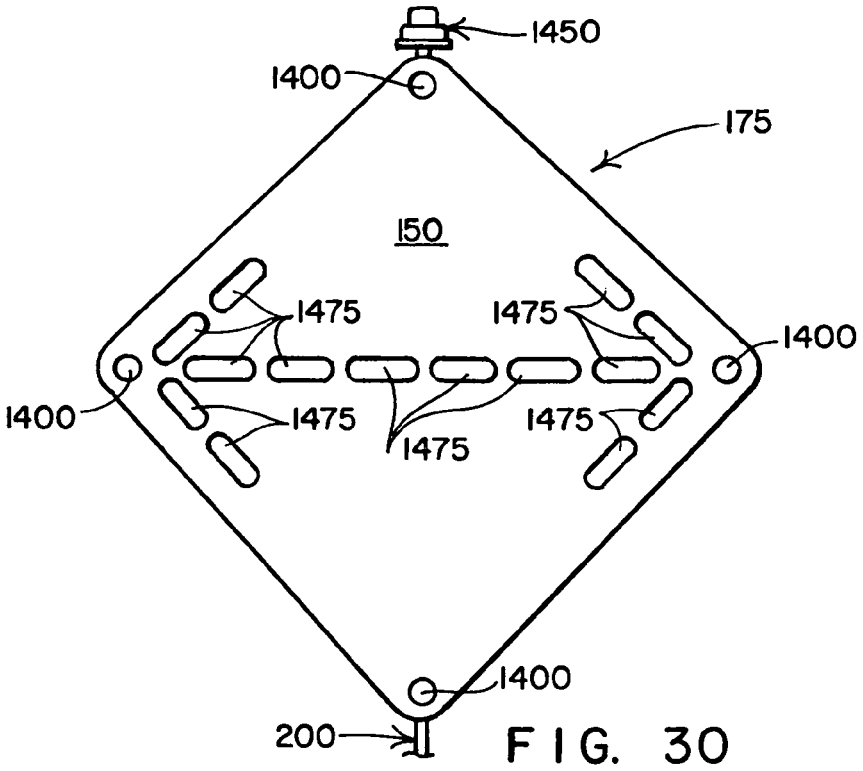
FIG. 30 is a front elevational view of a roadway safety sign assembly that includes an alternate form of roadway safety sign as well as several of the support components that are shown in FIG. 16 and a set of so-called "sequence lights" that can be lighted in sequences that form arrows for directing approaching traffic to the right and to the left; and, FIG. 31 is a rear elevational view of the sign assembly of FIG. 30, showing a housing that may be provided to protectively enclose portions of the lights, the support components, and the wiring harness that supplies power to the lights, with depending portions of the wiring harness carrying waterproof electrical connectors for receiving power and control signals to operate the lights.
Figure 31:
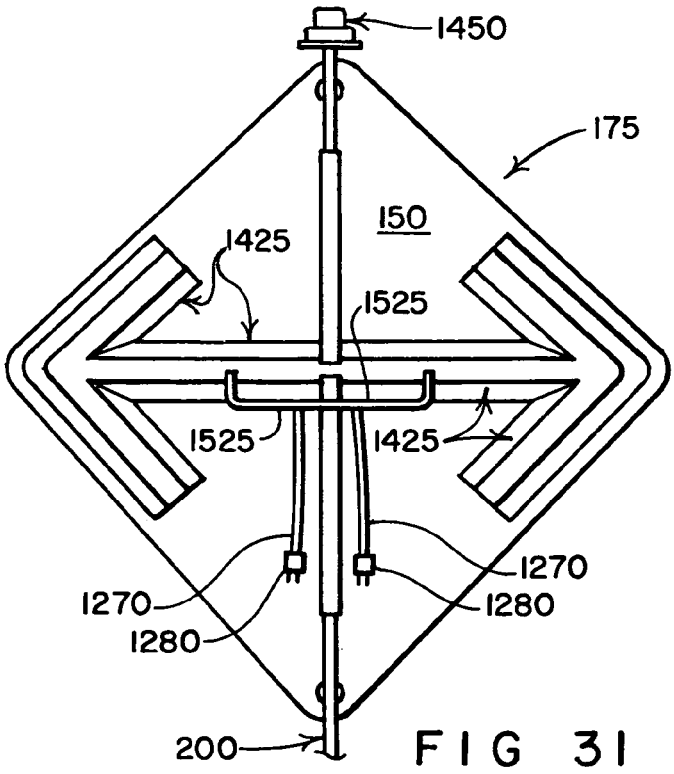

Referring to FIGS. 1-3, a multipurpose sign base or "MSB" for supporting roadway safety signs and the like is indicated generally by the numeral 100. A typical roadway safety sign 150 of square or diamond shaped configuration is shown connected to an upper end region 206 of an elongate mast 200 of the multipurpose sign base 100. Other depictions of typical roadway safety signs 150 that may be carried by the multipurpose sign base 100 are shown in FIGS. 8, 9, 12, 14 and 16. FIGS. 30 and 31 depict a roadway safety sign assembly 175 that can be supported by the mast 200 in place of one of the signs 150 shown in FIGS. 1-3, 8, 9, 12, 14 and 16 when support components that are incorporated into the assembly 175 are connected to an upper region of the mast 200, as will be explained in greater detail.

The mast 200 includes an assembly of telescopically extensible and retractable components that permit one of the roadway safety signs 150 (or a sign assembly such as the sign assembly 175 that is shown in FIGS. 30 and 31) to be supported at a selection of extended and retracted heights, such as are shown in FIGS. 1, 2, 3, 8 and 9. At its lower end 202, the mast 200 is welded to a substantially horizontally extending support member 300. As can be seen in FIGS. 1-3, 11 and 20, the horizontal support member 300 has a forwardly projecting tubular portion 385 and a rearwardly projecting tubular portion 320.

Figure 18:
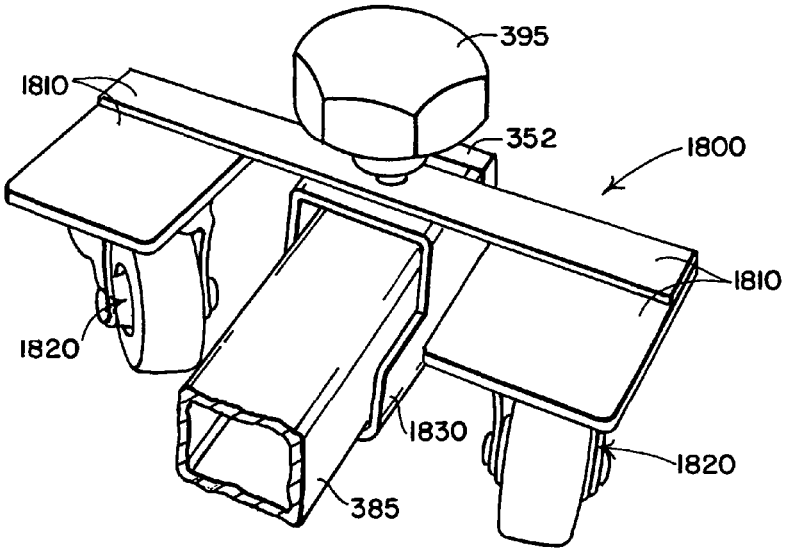
FIG. 18 is a perspective view, on an enlarged scale, showing an optional caster-carrying dolly installed on a front portion of the horizontally extending support member of the multipurpose sign base, and showing a vertically extending part of an L-shaped front foot capping the front of the horizontally extending support member.

The forwardly projecting tubular portion 385 of the horizontal support member 300 carries a front extension component 375 that is shown extended from within the horizontal support member 300 in FIGS. 1-3 and 19. An L-shaped front foot 350 is movably connected to a bottom surface of the front extension component 375, and is shown turned transversely with respect to the front extension component 375 in FIGS. 1-3. A horizontally extending part 351 of the L-shaped front foot 350 can be turned to extend transversely with respect to the front extension component 375 as shown in FIGS. 1-3, or can be turned to align with the front extension component 375 in the manner shown in FIG. 19. The horizontally extending part 351 is sized so that it and the entire length of the front extension component 375 can retract into the open front end of the tubular front portion 320 of the horizontal support member 300, leaving only a vertically extending part 352 of the L-shaped front foot 350 exposed to serve as a square cap closing the open front end of the tubular front portion 320 of the horizontal support member 320, as depicted in FIG. 18.

The rearwardly projecting portion 320 of the horizontally extending support member 300 preferably has a square cross-section sized to be received in a slip-fit in a square opening of a standard size hitch housing, such as is commonly provided at the rear of pickup trucks and other over-the-road vehicles. A typical hitch housing 30 is shown mounted beneath an over-the-road vehicle's rear bumper 26 in FIGS. 20-22. If, as just described, the rearwardly projecting portion 320 of the horizontal support member 300 is hitch-housing-insertable, this renders it possible for the sign base 100 and a roadway safety sign 150 carried thereby to be operably supported (in a manner shown in FIG. 12) at the rear of an over-the-road vehicle, such as the depicted pickup truck 25.

Figure 26:
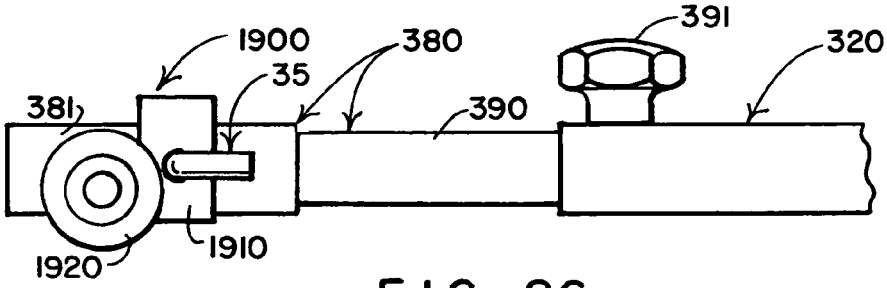
FIG. 26 is a view similar to FIG. 25, showing an optional wheel-carrying rear dolly connected to the rear extension component by the L-shaped hitch pin.
Figure 27:
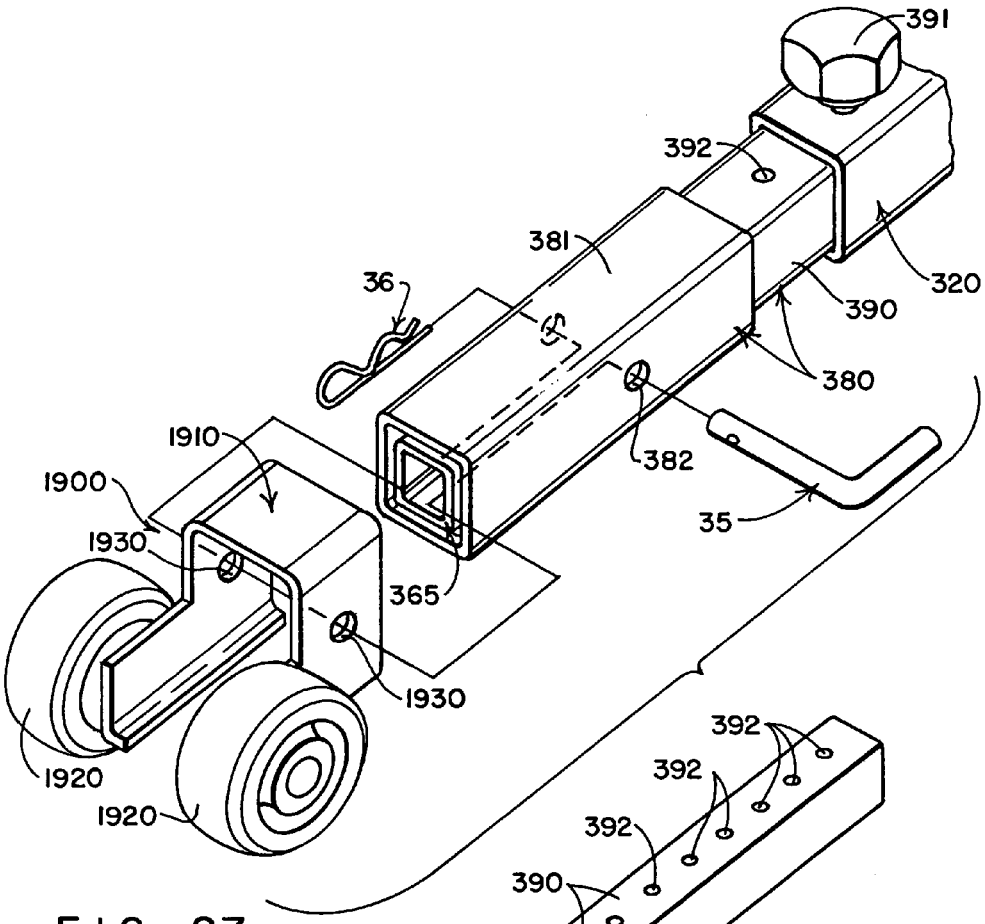
FIG. 27 is an exploded perspective view showing the rear extension component partially extended from within the rear portion of the horizontally extending support member, showing the hitch adapter in its retracted position nestled within the rear extension component, showing the optional wheel-carrying rear dolly separated from and ready to be installed onto the rear extension component, showing the L-shaped hitch pin removed from the rear extension component, and showing a spring clip that can be used to retain the hitch pin in an installed position.
Figure 28:
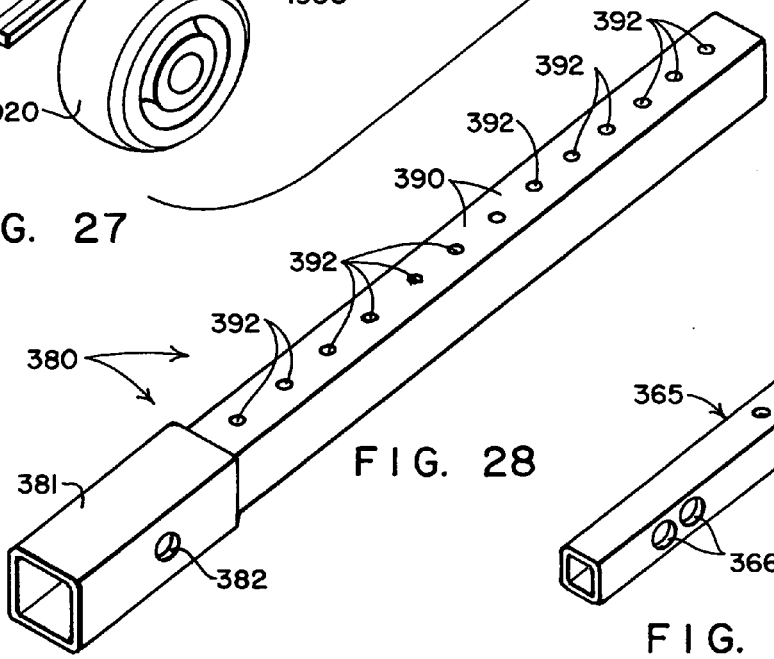
FIG. 28 is a perspective view, on a diminished scale, of the rear extension component.

An additional feature of the tubular, rearwardly extending portion 320 of the horizontal support member 300 is its ability to carry and to partially protectively enclose a rear extension component 380 of the type that is shown all by itself in FIG. 28, and is shown in each of FIGS. 20-27 while extending at least partially into the rearwardly extending portion 320 of the horizontally extending support member 300. The rear extension component 380 has an elongate main portion 390 best shown in FIG. 28, and an enlarged end formation 381 that is shown in FIGS. 23-26 and 28. A knob-operated bolt 391 is provided that can extend into holes 392 defined by the elongate portion 390 to hold the rear extension component 380 in its retracted position shown in FIGS. 20, 23 and 24, and in various extended positions such as are shown in FIGS. 21, 22 and 25-27.

Figure 12:
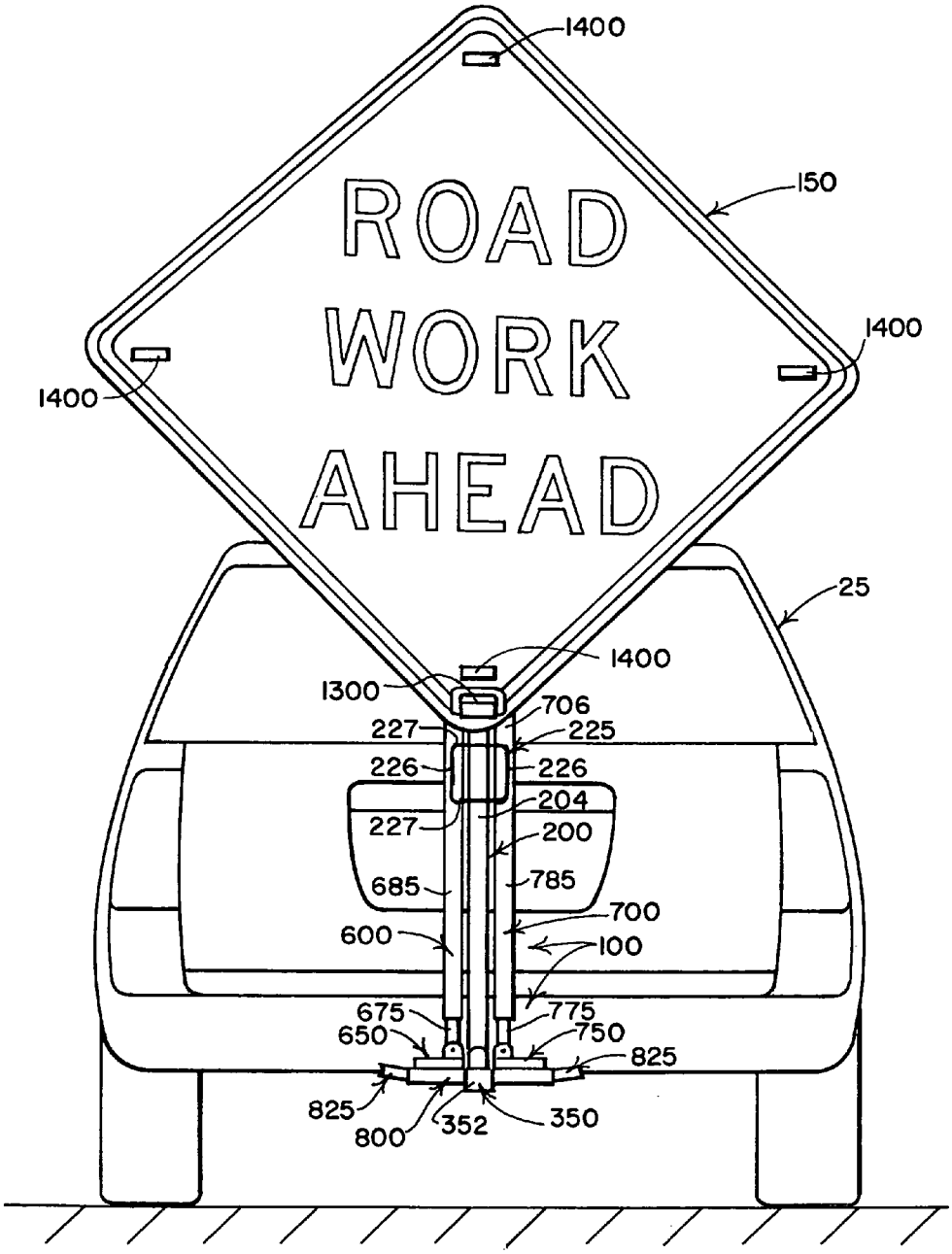
FIG. 12 is a front view, on an enlarged scale, of the sign base and sign supported at the rear of a pickup truck, with the view showing lights that are provided on the sign near each of the four corners thereof, with the legs of the sign base retracted, and with an optional dual-handle element connected to a central region of the mast.

The size of the enlarged rear end region 381 is selected to be hitch-housing-insertable in a slip fit, just as the rear end region 320 of the horizontally extending support member 300 is sized to be hitch-housing-insertable, as described just above, which provides two different ways in which the sign base 100 and a sign 150 carried thereby can be supported by a hitch housing at the rear of an over-the-road vehicle such as the pickup truck 25 shown in FIG. 12, namely by directly inserting the rear end region 320 into the hitch housing 30 when the rear extension member 380 is removed from the horizontally extending support member 300, or by inserting the enlarged end region 381 into the hitch housing 30 when the rear extension member 380 is telescopically connected to the horizontally extending support member 300.

Figure 20:
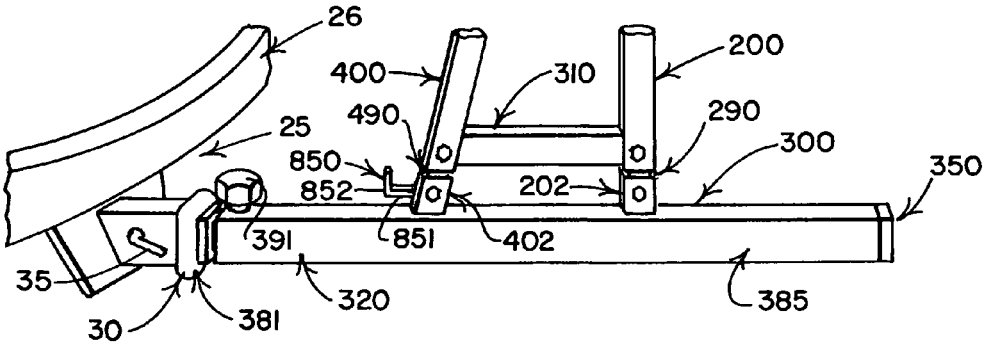
FIG. 20 is a perspective view, on an enlarged scale, showing a rear extension component that has one end region thereof telescopically connected to a rear portion of the horizontally extending support member, and an opposite hitch-housing-engageable end region thereof extending into and connected by a hitch pin to a housing of a hitch such as is commonly found at the rear of vehicles such as the pickup truck shown in FIG. 12, with the rear extension component shown in its retracted position.
Figure 21:
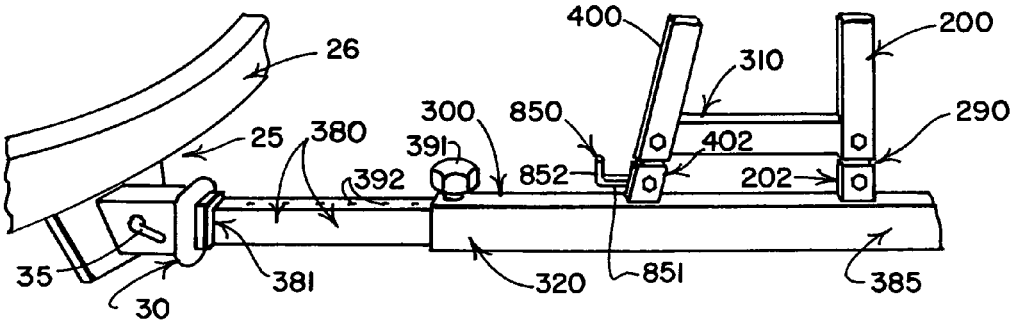
FIG. 21 is a perspective view similar to FIG. 20, but with the rear extension component partially extended from within the rear portion of the horizontally extending support member.
Figure 22:
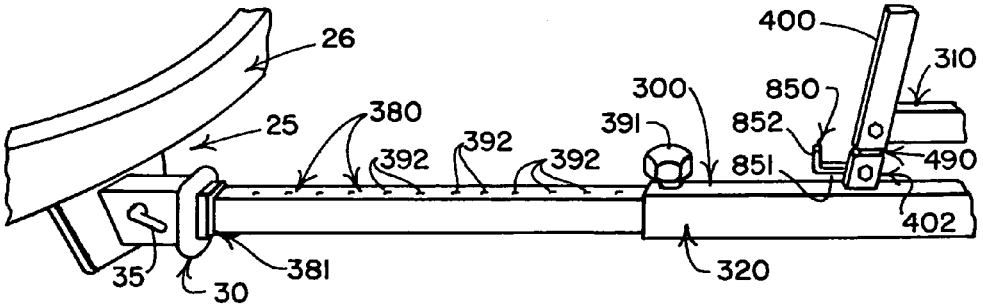
FIG. 22 is a perspective view similar to FIGS. 20 and 21, but with the rear extension component in a fully extended position.
Figure 23:
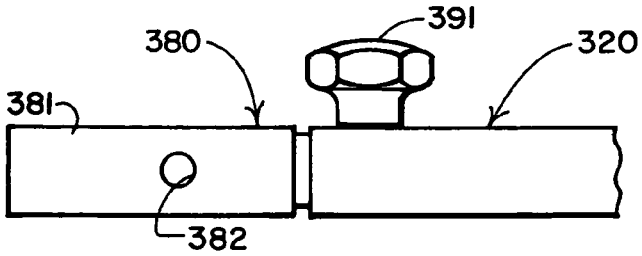
FIG. 23 is a side elevational view showing a rear portion of the horizontally extending support member, and showing the hitch-housing-engageable end region of the rear extension component, with the rear extension component in its retracted position.

The enlarged end formation 381 can be inserted into the hitch housing 30 when the rear extension member 380 is retracted, as is shown in FIG. 20; or when the rear extension member 380 is partially extended, as is shown in FIG. 21; or when the rear extension member 380 is fully extended relative to the horizontally extending support member 300, as is shown in FIG. 22. Likewise, when the enlarged end region 381 is already inserted into the hitch housing 30 and is securely connected thereto (typically by a conventional L-shaped hitch pin 35 of the type shown in FIG. 27 typically held in place by a spring clip 36 of the type also shown in FIG. 27), the rear extension member 380 can be moved relative to the horizontally extending support member 300 between its retracted position shown in FIGS. 20, 23 and 24, and its fully extended position shown in FIG. 22, to vary the distance between the hitch housing 30 and the horizontally extending support member 300 to provide room for a pickup truck's tailgate (not shown) to be operated without being obstructed by components of the sign base 100.

Figure 29:
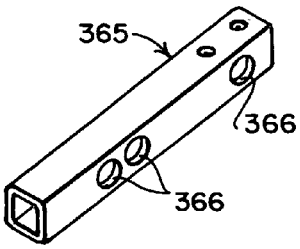
FIG. 29 is a perspective view, on a diminished scale, of the hitch adapter.

If the multipurpose sign base 100 needs to be connectable to a vehicle hitch housing (not shown) that is of smaller standard size than the hitch housing 30 shown in FIGS. 12 and 20-22, then an elongate, tubular hitch adapter 365 (having a square cross-section sized to be received in a slip fit in the smaller size hitch housing) such as is shown in FIG. 29 may be carried in a retracted and out-of-the-way position nestled within the enlarged rear end region 381 of the rear extension component 380 in the manner shown in FIG. 27. When needed, the hitch adapter 365 can be moved to an extended position shown in FIG. 24 for insertion into the smaller size hitch housing (not shown).

A conventional L-shaped hitch pin 35 of the type shown in FIG. 27 preferably is used to extend through one of several holes 366 (FIG. 29) defined by the hitch adapter 365 and a hole 382 formed through the enlarged end region 381 (FIGS.

Figure 24:
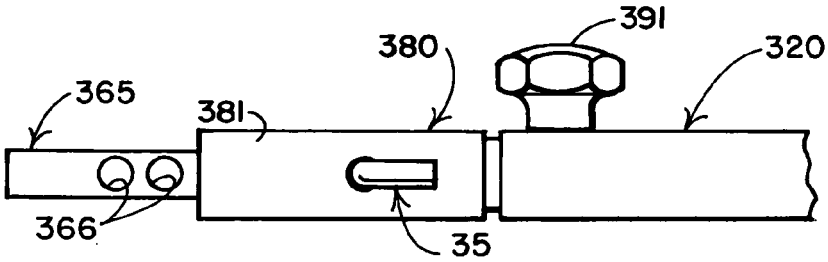
FIG. 24 is a view similar to FIG. 26, but with an optional hitch adapter (that can be nestled within the components of FIG. 23) shown partially extended from within the components of FIG. 23, and with the adapter being connected to the rear extension component by an L-shaped hitch pin that has been inserted through aligned holes of the rear extension component and the adapter.
Figure 25:
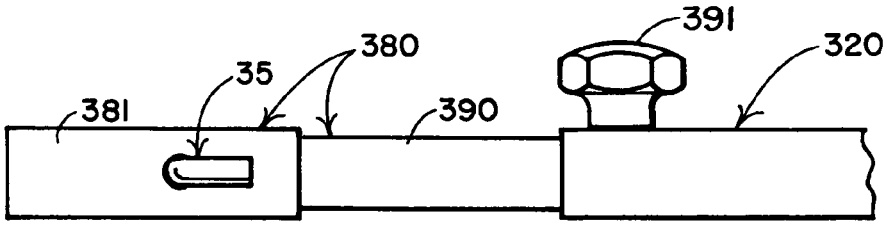
FIG. 25 is a view similar to FIG. 26, but with the rear extension component partially extended relative to the rear end portion of the horizontally extending support member, and with the L-shaped hitch pin shown inserted into a hole of the rear extension member that can be seen in FIG. 23, where it may also serve to retain the optional hitch adapter within the confines of the rear extension component.

23 and 27), and is secured by a spring clip 36 of the type shown in FIG. 27 to retain the hitch adapter 365 in its retracted position shown in FIG. 27, and, alternatively, its extended position shown in FIG. 24. An identical L-shaped hitch pin 35 and spring clip 36 may be used to extend through aligned holes defined by a vehicle hitch housing, by the hitch adapter 365 and by the rear extension component 380 to establish connections therebetween when either the hitch adapter 365 or the rear extension component 380 is inserted into a vehicle hitch housing of appropriate size. Such a use of one of the hitch pins 35 is shown in FIGS. 20-22.

Referring again to FIGS. 1-3, the sign base 100 includes a diagonal brace 400 that has a lower end region 402 welded to the rearwardly projecting portion 320 of the horizontal support member 300, and an upper end region 406 welded to a central region 204 of the mast 200. The diagonal brace 400 rigidifies and strengthens the welded connection of the mast 200 to the horizontal support member 300, and helps to assure that the full weight of the sign base 100 and the sign 150 can be supported by the horizontal support member 300, as is the case when the rearwardly projecting portion 320 of the support member 300 (or the enlarged end formation 381 of the rear extension component 380) is inserted into a hitch housing 30 (see FIGS. 20-22) to support the sign base 100 and one of the roadway safety signs 150 at the rear of a pickup truck 25, as is shown in FIG. 12.

The diagonal brace 400 forms the hypotenuse of a right triangle, remaining sides of which are defined by the rearwardly projecting portion 320 of the horizontal support member 300, and a lower part of the mast 200 (including the lower end region 202 and a lower part of the central region 204 of the mast 200). The strength and rigidity provided at the heart of the multipurpose sign base 100 by the right triangle (formed by the 200/300/400 series of components just described) gives the sign base 100 a degree of structural integrity and stability not offered or equaled by previously proposed bases designed for temporarily supporting roadway safety signs and the like.

To further strengthen and rigidify the support structure of the multipurpose sign base 100, an optional strut 310 may be provided to extend between the mast 200 and the brace 400 at a location spaced a few inches upwardly from the horizontally extending support member 300, as shown in FIGS. 20-22. The strut 310 preferably is arranged to parallel the horizontally extending support member 300. Opposite end regions of the strut 310 are welded to the mast 200 and to the brace 400, preferably at locations slightly above where breakaway assemblies 290, 490 (best shown in the same view in FIGS. 3, 20 and 21) are provided within lower portions of the mast and brace 200, 400, respectively.

The breakaway assemblies 290, 490 constitute a safety feature of the multipurpose sign base 100, and include components of diminished cross-section and diminished structural strength that do nothing to interfere with the normal day-to-day structural performance of the mast 200 and the brace 400, but are perpetually ready to permit the mast 200 and the brace 400 to be severed from the horizontal support member 300 at near-to-ground-level locations in the event that a moving vehicle or other sizable moving object should impact portions of the sign base 100 or the sign 150 at locations above where the breakaway assemblies 290, 490 are provided.

The optional addition to the sign base 100 of the horizontal strut 310 (shown in FIGS. 20-22) to connect lower portions of the brace 400 and the mast 200 helps to maintain the angular relationship between the brace 400 and the mast 200, so that, in at least some instances of minimal impact damage to the sign base 100, service personnel are able to quickly and easily return the multipurpose sign base 100 to functional use simply by unbolting and replacing severed components of the breakaway assemblies 290, 490.

Figure 4:
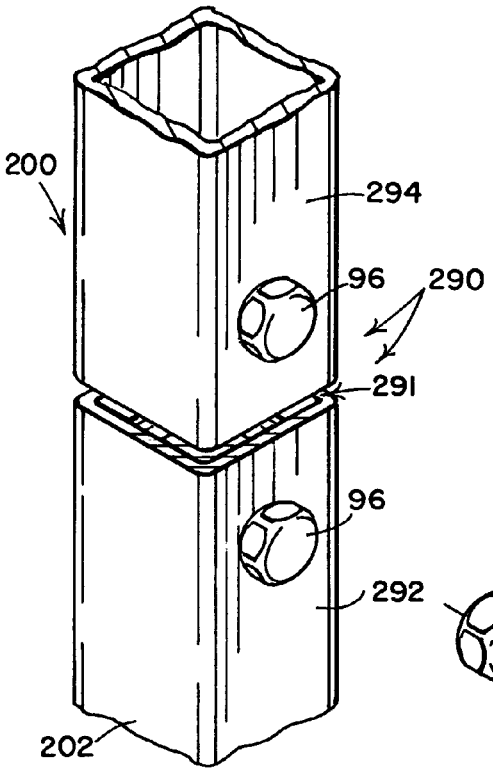
FIG. 4 is a perspective view, on an enlarged scale, of one of two identical breakaway assemblies that are employed by the sign base.

The breakaway assembly 290 is depicted on an enlarged scale in FIG. 4. The identically constructed breakaway assembly 490 is depicted with its components separated in FIG. 5. The breakaway assemblies 290, 490 employ identical elongate aluminum blocks 291, 491. The blocks 291, 491 have their cross-sections diminished and structurally weakened at central locations along their lengths by perimetrically extending grooves 92 that centrally wrap the blocks 291, 491, and by pairs of cross-drilled holes 94 at the same central-length locations. Tubular components 292, 294 that form the lower end region 202 of the mast 200 enclose opposite end regions of the weakened aluminum block 291, and are spaced from each other at the location of the block's groove 92. Tubular components 492, 494 that form the lower end region 402 of the brace 400 enclose opposite end regions of the weakened aluminum block 491, and are spaced from each other at the location of the block's groove 92. Threaded fasteners 96 extend through aligned holes drilled through the components 292, 294 and through the aluminum block 291 to connect the components 292, 294 to opposite end regions of the aluminum block 291; and, identical threaded fasteners 96 extend through aligned holes to connect the components 492, 494 to opposite end regions of the aluminum block 491.

When the sign base 100 is positioned atop a support or ground surface such as is indicated by the numeral 50 in FIGS. 1-3, components of the sign base 100 that are intended to engage portions of the surface 50 include the horizontally extending support member 300; an L-shaped front foot 350 that is carried by a front extension component 375 that is extensible forwardly from within an open front end region of the tubular front portion 385 of the horizontally extending support member 300; and plate-like feet 550, 650, 750 that are carried by lower end regions 502, 602, 702 of three leg assemblies or legs 500, 600, 700, respectively.

Figure 11:
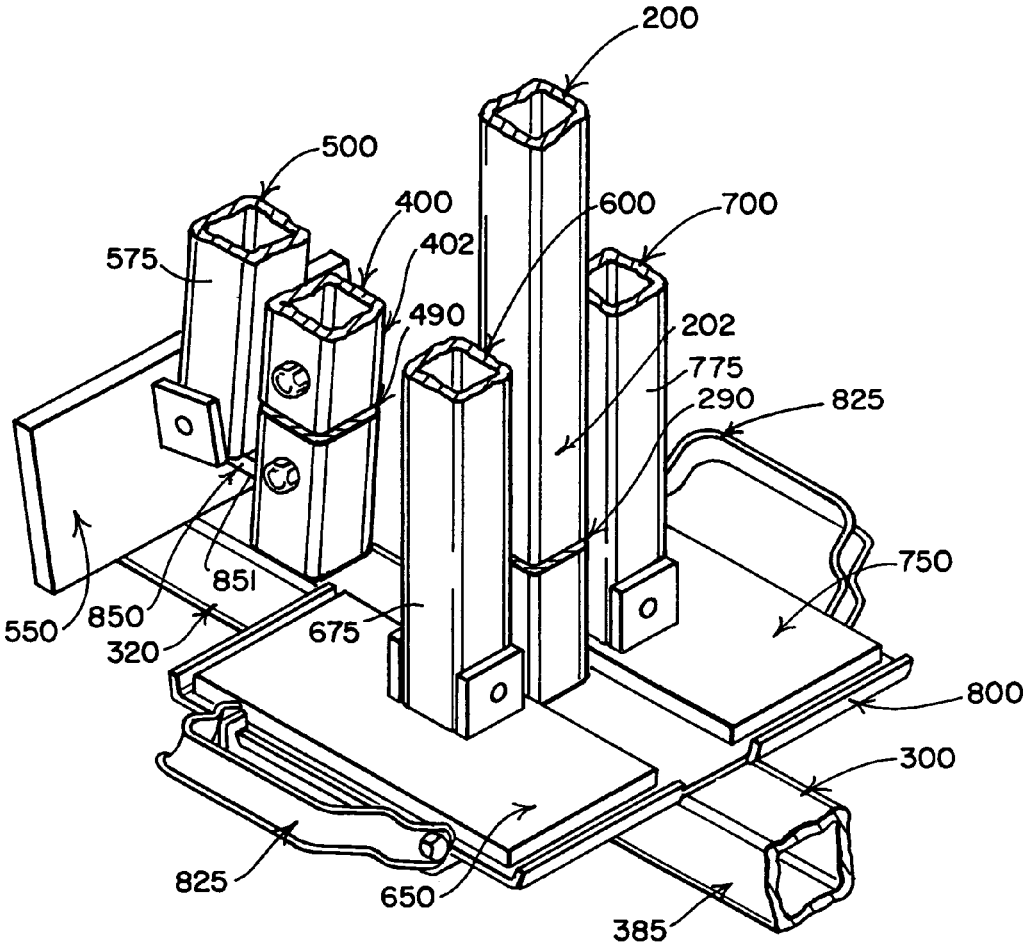
FIG. 11 is a perspective view, on an enlarged scale, showing how lower end regions of three legs and the feet they carry are releasably retained in retracted positions relatively near to a lower end region of the upstanding mast of the sign base.

Upper end regions 506, 606, 706 of the leg assemblies or legs 500, 600, 700, respectively, are pivotally connected to the central region 204 of the mast 200, thereby enabling the legs 500, 600, 700 to pivot away from the mast 200 in rearward, leftward and rightward directions to position the feet 550, 650, 750 to for engagement with the ground or support surface 50 at spaced locations arrayed about the mast 200 in the manner depicted in FIGS. 1-3), and to retract toward the mast 200 for storage and transport to locations shown in FIG. 11 that are relatively near the mast 200.

Figure 15:
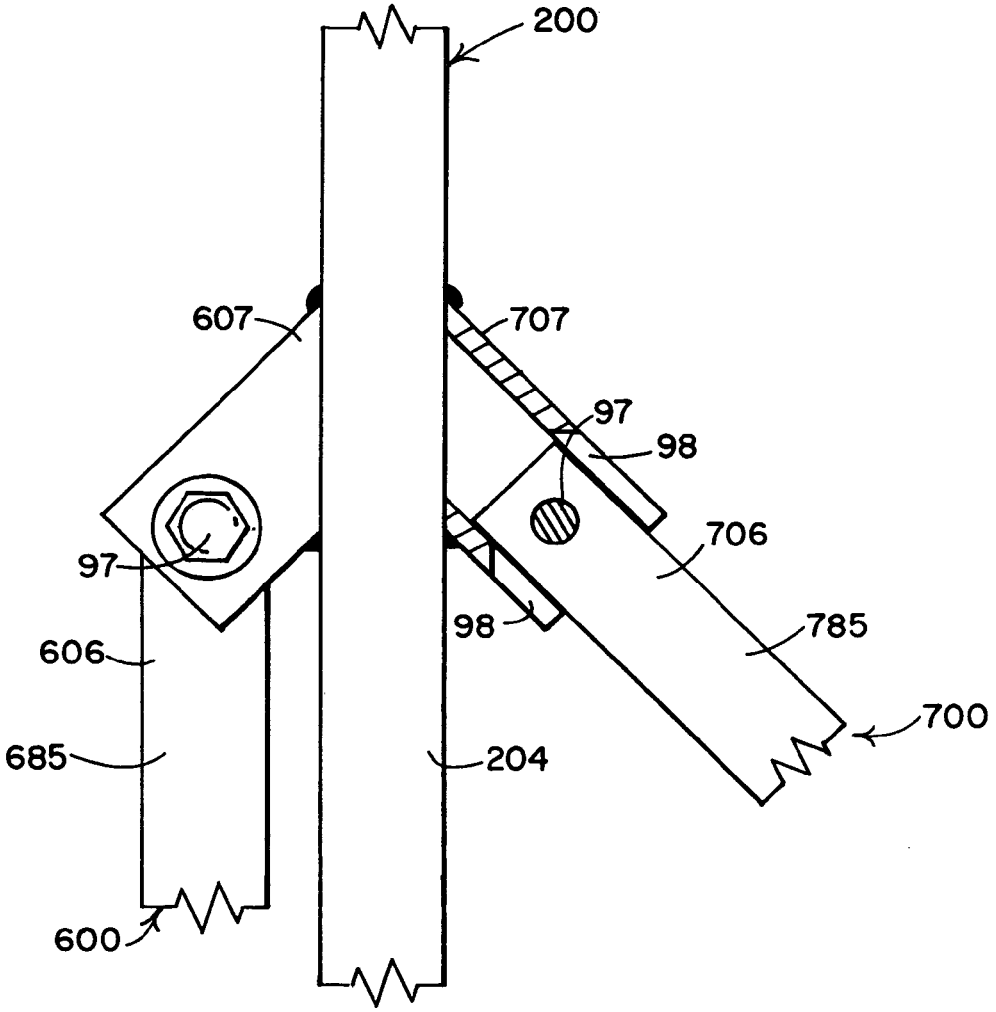
FIG. 15 is a front elevational view, on an enlarged scale, showing pivotal connections of upper end regions of the left and right legs to a component of the upstanding mast of the sign base, with right portions broken away and shown in cross-section.

The upper end regions 506, 606, 706 of the legs 500, 600, 700, respectively, are each pivotally connected to the central region 204 of the mast 200 in substantially the same manner. Identically configured hinge brackets 507, 607, 707 (two of which are shown in each of FIGS. 1-3 and 15) are welded to rear, left and right sides, respectively, of the central region 204 of the mast 200. The hinge brackets 507, 607, 707 depend at similar angles of inclination relative to the mast's central region 204. Referring to FIG. 15 (where an external portion of one of the identical hinge brackets 607 is shown, and where another of the identical hinge brackets 707 is shown in cross-section), it will be understood that each of the hinge brackets 507, 607, 707 is provided with aligned holes in its opposite sides that carry one of three identical hinge bolts 97 (two of which are shown in FIG. 15) that also extend through aligned holes formed through upper portions of an associated upper end region 506, 606, 706 of an associated one of the legs 500, 600, 700.

The hinge bolts 97 and the brackets 507, 607, 707 cooperate to pivotally connect the upper end regions 506, 606, 707 of the legs 500, 600, 700, respectively, to the central region 204 of the mast 200. As can be understood from viewing the cross-sectional depiction in FIG. 15 of the typical hinge bracket 707, each of the identical hinge brackets 507, 607, 707 has cut-away portions 98 that permit an associated upper end region 506, 606, 707 of an associated one of the legs 500, 600, 700 to pivot relative to the associated hinge bracket 507, 607, 707, respectively, so the left and right legs 600, 700 are permitted to pivot to retracted positions extending closely alongside the mast 200 as shown in FIGS. 11 and 12, and so the rear leg 500 is permitted to pivot to a retracted position extending closely alongside the brace 400 as shown in FIG. 11.

The combination of ground-engaging elements that includes the horizontally extending member 300 (which carries the L-shaped front foot 350) and the rear, left and right leg members 500, 600, 700 (which carry the rear, left and right feet 550, 650, 750, respectively), wherein all four of the members 300, 500, 600, 700 are connected to the mast 200, provides the mast 200 with a firm degree of ground support, strength and rigidity that is not offered or equaled by previously proposed bases designed to temporarily support roadway safety signs and the like.

The feet 550, 650, 750 (which are shown in FIGS. 1-3, and more clearly on an enlarged scale in FIG. 11) are relatively flat, plate-like members that are pivotally connected to tubular lower components 575, 675, 775 of the legs 500, 600, 700 which, in turn, are telescopically connected to tubular upper components 585, 685, 785 of the legs 500, 600, 700, respectively. Sand bags or other weights (not shown) may be positioned atop the feet 350, 550, 650, 750 to assist in retaining the feet 350, 550, 650, 750 at desired locations atop the support surface 50.

The leg 500 is a rear leg, and the foot 550 is a rear foot. The leg 600 is a left leg, and the foot 650 is a left foot. The leg 700 is a right leg, and the foot 750 is a right foot. Rear, left and right locking knobs 595, 695, 795 (all of which are shown in FIG. 1) have supporting stems (that are identical to a threaded stem 296 shown most clearly in FIG. 6) that are threaded through holes formed through sidewalls of the rear, left and right tubular members 585, 685, 785, and can be tightened into engagement with the tubular members 575, 675, 775 to lock together the paired tubular members 575, 585, and 675, 685 and 775, 785 once the lengths of the telescopically extensible and retractable legs 500, 600, 700 have been adjusted to plant the feet 550, 650, 750, respectively, firmly in engagement with the ground or support surface 50 (FIGS. 1-3) so the base 100 is properly supported by the legs 500, 600, 700 and by the feet 550, 650, 750 working in concert with the horizontal support member 300, the front extension component 375, and the L-shaped front foot 350, any or all of which may engage the underlying ground or support surface 50.

When the rear leg 500 is to be moved from an extended position (FIGS. 1-3) to its retracted position shown in FIG. 11, the length of the rear leg 500 first is shortened so the open bottom end of the lower component 575 of the rear leg 500 can be raised over an L-shaped hook 850 (shown in FIGS. 2, 3 and 20-22), whereafter the bottom end of the lower component 575 is lowered onto the hook 850 so that a vertically extending part 852 (FIGS. 20-22) of the L-shaped hook 850 extends into the open bottom end region of the component 575, and so that a bottom end surface of the lower component 575 engages and is supported by a horizontally extending part 851 (FIGS. 20-22) of the L-shaped hook 850 (in a manner shown only in FIG. 11). The locking knob 595 of the rear leg 500 is then tightened to hold the rear leg 500 in place in its retracted position where it is supported and held in place by the hook 850.

When the left and right legs 600, 700 are to be moved from extended positions (such as are shown in FIGS. 1-3) to their retracted positions shown in FIG. 11, the lengths of the left and right legs 600, 700 first are shortened to permit the feet 650, 750 to be moved to locations above left and right side regions of a tray 800 that preferably is provided near the lower end of the mast 200, whereafter the left and right feet 650, 750 are lowered to their retracted positions in engagement with the left and right side regions of the tray 800 so as to be supported by the tray 800. The locking knobs 695, 795 are then tightened to hold the left and right legs 600, 700 and the left and right feet 650, 750, respectively, in their retracted positions.

The tray 800 sits atop and is welded to the forwardly projecting portion 385 of the horizontal support member 300. As can be seen in FIG. 11, opposite left and right side regions of the tray 800 are provided with handles 825 that can be grasped when the sign base 100 (with its legs 500 and 600, 700 retracted and supported by the hook 850 and by the tray 800, respectively, in the manner just described, and as shown in FIG. 11) is to be manually carried from one location to another.

To ensure that the sign base 100 is of relatively lightweight construction, and yet exhibits adequate strength and rigidity to support roadway safety signs and the like in a stable and reliable manner (even when subjected to wind, conditions of inclement weather, and forces imposed by air currents resulting from the nearby passage heavy trucks and other vehicles), components that form the mast 200, the support member 300, the brace 400 and the legs 500, 600, 700 are preferably formed from lengths of relatively lightweight steel tubing of square cross-section that are protected by corrosion resistant coatings. Several adjacent pairs of the tubular steel components that form the mast 200 and the legs 500, 600, 700 are telescopically connected for extension and retraction—so that, for a first example, the length of the mast 200 may be increased and decreased as desired to permit the roadway safety sign 150 to be supported at a variety of desired heights, examples of which are shown in FIGS. 1, 2, 3, 8 and 9; and so that, for a second example, the lengths of the legs 500, 600, 700 can be increased and decreased as needed to position the feet 550, 650, 750 in firm engagement with selected portions of the ground or support surface 50 that may be pitted rather than flat, and may slope rather than extend horizontally, or may otherwise be of irregular character.

Figure 6:
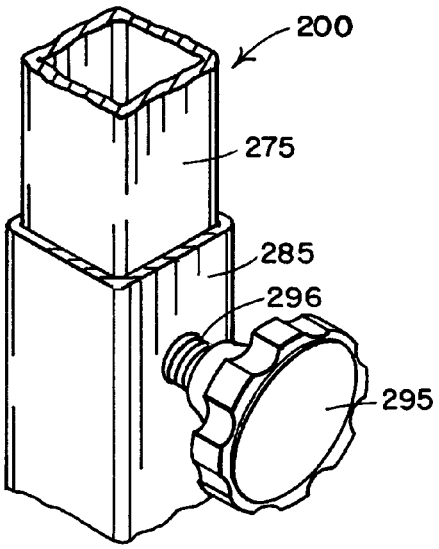
FIG. 6 is a perspective view, on an enlarged scale, of a pair of telescopically adjustable components of the sign base.
Figure 10:
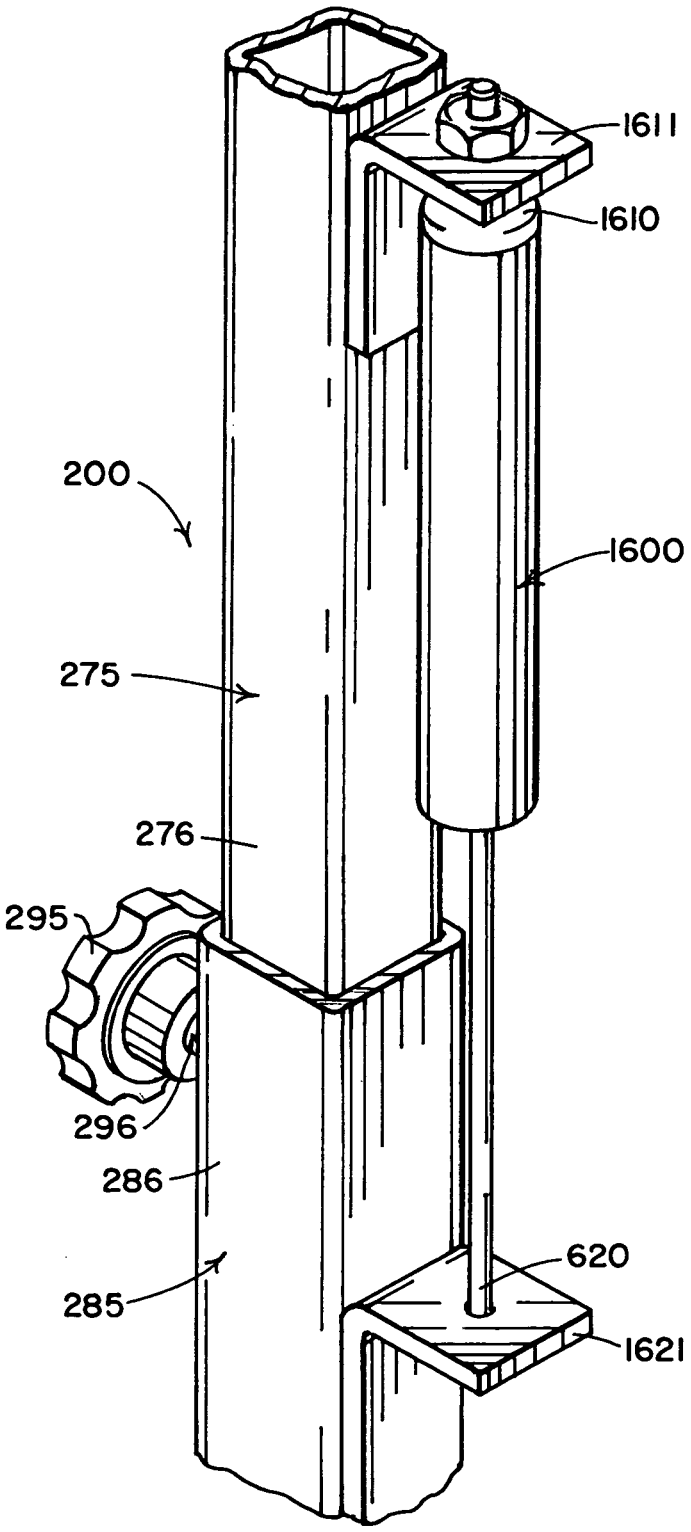
FIG. 10 is a perspective view, on an enlarged scale, of telescopically extended lower and upper mast components of the sign base with an optional gas spring connected thereto and interposed therebetween.
Figure 16:
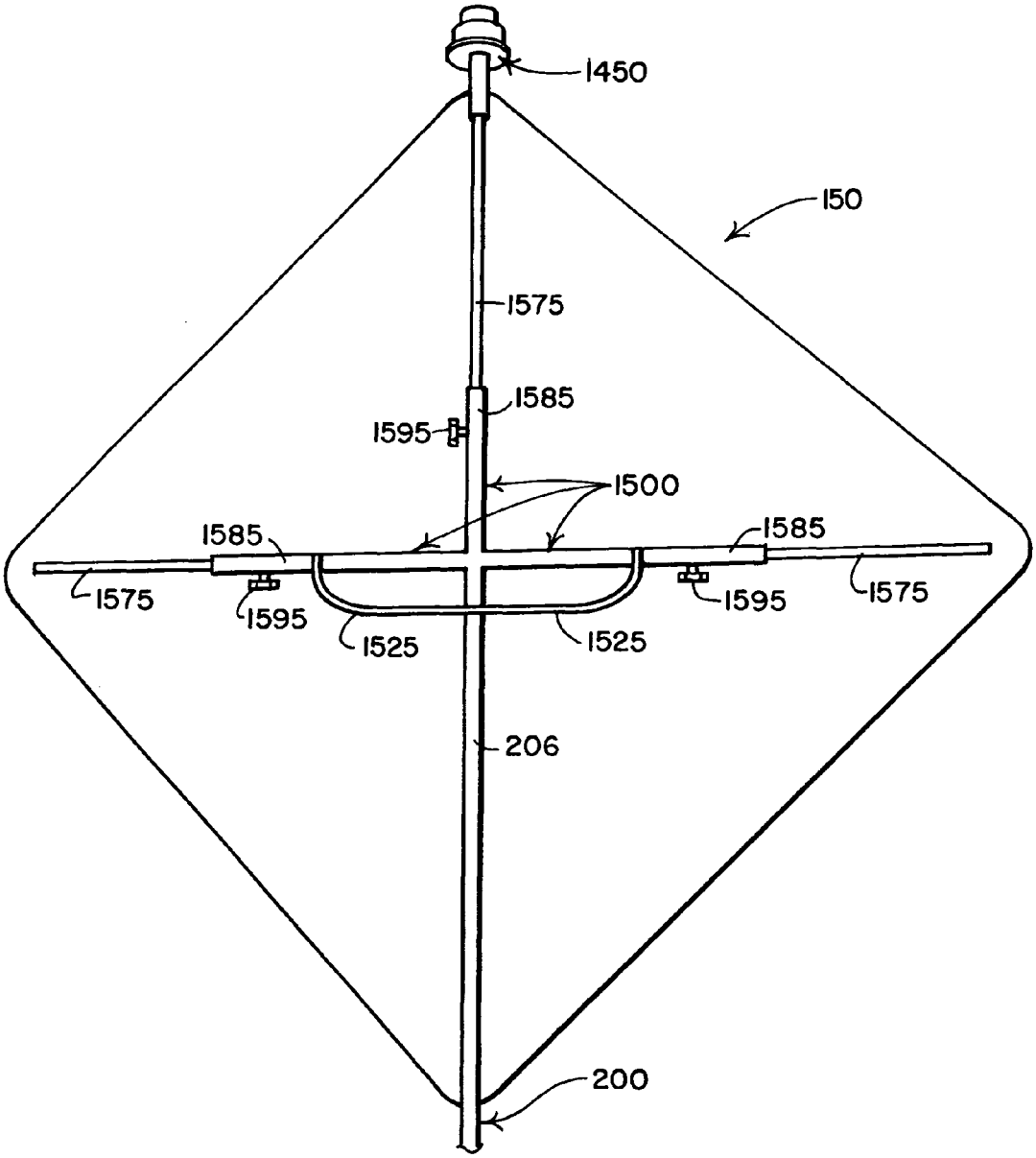
FIG. 16 is a rear elevational view showing upper components of the multipurpose sign base that extend across rear surface portions of a roadway safety sign and are provided with an optional handle structure and an optional beacon light mounted atop the mast.
Figure 17:
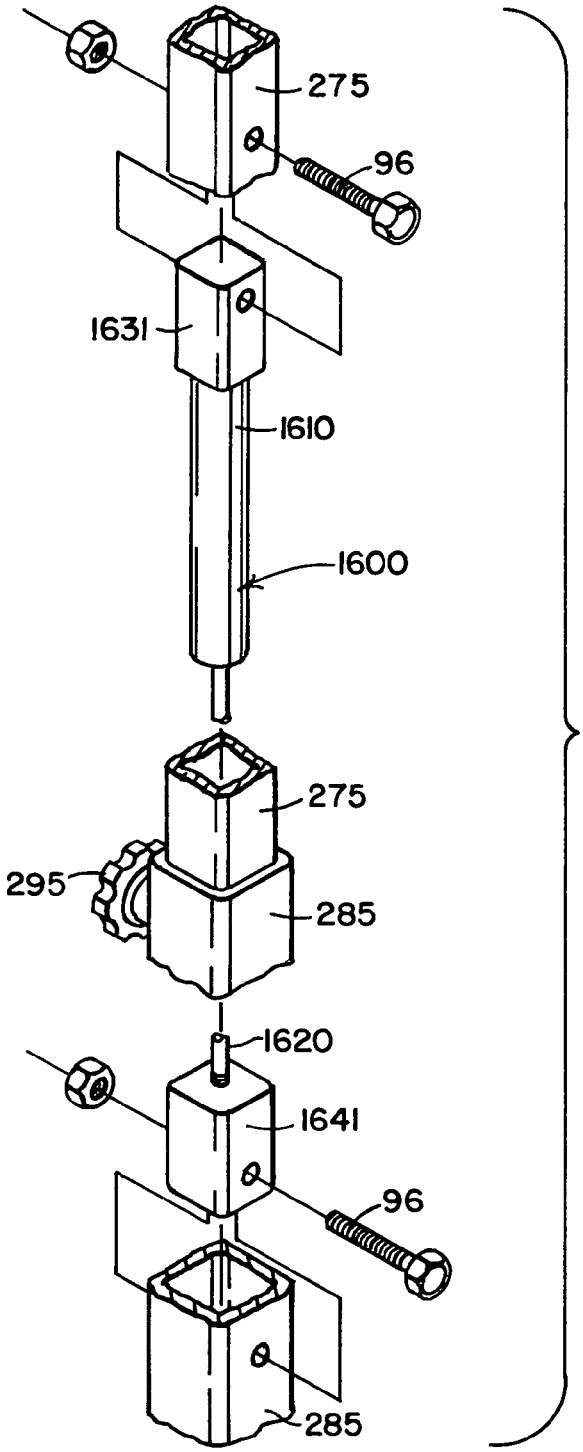
FIG. 17 is an exploded perspective view of telescopically connected components of the mast, with the view showing how a gas spring may be connected to and protectively enclosed by the depicted mast components.

What is meant herein by describing pairs of adjacent components as being "telescopically connected" or as being "telescopically extensible and retractable" is that one of the two adjacent components has a larger cross-section than the other (i.e., it can be said to be a larger component than the other), and that a portion of the other component (i.e., the smaller component) is received in a slip fit within a portion of the larger component, so the smaller component can move smoothly and easily relative to the larger component, or vice versa, to permit the combined length of these two-component assemblies to be adjusted. As those who are skilled in the art will appreciate, adjacent components forming such assemblies need not be formed from tubular stock of square cross-section; however, the use of well-fitting components of square cross-section has the advantage of preventing telescopically connected components (such as the components 275, 285 shown in FIGS. 6 and 10) from twisting relative to each other, which enhances the stability with which the sign base 100 is able to support roadway safety signs and the like.

Where assemblies of pairs of adjacent telescopically connected tubular components of square cross-section are shown in the accompanying drawings, the component having the larger cross-section (i.e., the larger component) typically is indicated by a numeral ending in "85," the component having the smaller cross-section (i.e., the smaller component) typically is indicated by a numeral ending in "75," and an associated locking knob typically is indicated by a numeral ending in "95." For example, in FIGS. 6, 10 and 17, larger and smaller adjacent telescopically connected components of the mast 200 are indicated by the numerals 285, 275, respectively, and associated locking knobs are indicated by the numeral 295. Likewise, in FIGS. 1-3 and 19, larger and smaller telescopically connected components at the front of the horizontally extending support member 300 are indicated by the numerals 385, 375, respectively, and an associated locking knob is indicated by the numeral 395; and, in FIGS. 2, 3 and 16, larger and smaller telescopically connected components located behind and connectable to the sign 150 (and to other signs, not shown, that are interchangeable with the sign 150 and may be of different size or shape) are indicated by the numerals 1585, 1575, respectively, with associated locking knobs being indicated by the numeral 1595.

A plurality of assemblies of telescopically connected components (such as the components 285, 275 shown in FIGS. 6 and 10) preferably are used to form the upstanding mast 200; and a plurality of the locking knobs 295 (that also are shown on an enlarged scale in FIGS. 6 and 10) preferably are provided at spaced locations along the length of the mast 200 (as can be seen in FIGS. 2, 3, 8 and 9) to releasably retain relatively movable components of the mast 200 in desired extended and retracted positions. The number of pairs of telescopically connected tubular components employed to form the mast 200 may vary, depending on the desired heights, and the desired range of heights, at which a particular sign base 100 is required to support a roadway safety sign or the like.

Although FIGS. 6, 10 and 17 show a smaller tubular component 275 situated above a larger tubular component 285, this smaller-above-larger relationship is not essential and may, in fact, be reversed. For example, the legs 500, 600, 700 can be seen in FIGS. 1-3 to employ relatively large tubular components 585, 685, 785 that are situated above relatively smaller tubular components 575, 675, 775 that connect with the feet 550, 650, 750, respectively. Locking knobs 595, 695, 795 are provided to retain the paired, adjacent components 575, 585 and 675, 685 and 775, 785, respectively, in retracted and extended positions to which these paired components have been relatively moved.

What is illustrated in FIG. 10 is that a pair of adjacent telescopically connected components 275, 285 may be connected by brackets 1611, 1621 to opposite end regions 1610, 1620 of a conventional, commercially available gas spring 1600. As those skilled in the art are aware, the gas spring 1600 is a shock-absorber-like assembly that is capable of storing energy when its opposite end regions 1610, 1620 are pressed relatively toward each other (i.e., when the length of the gas spring 1600 is compressed), and of releasing the stored energy when its opposite end regions 1610, 1620 are permitted to move relatively away from each other (i.e., when the length of the gas spring 1600 is permitted to extend). What is referred to herein by saying that a gas spring is "interposed between" a pair of telescopically connected components is that opposite end regions of a gas spring are connected to different ones of the paired components by whatever mechanical means a designer may deem suitable for use in a particular situation, for example by use of the brackets 1611, 1621.

What is illustrated in FIG. 17 is that a pair of adjacent telescopically connected components 275, 285 may be connected by internally carried, elongate metal blocks 1631, 1641 to the opposite end regions 1610, 1620 of the conventional, commercially available gas spring 1600, thereby permitting the gas spring 1600 to be protectively enclosed within, while being connected to, the telescopically connected components 275, 285. Threaded fasteners 96 are provided to extend through aligned holes formed through the components 275, 285 and through the metal blocks 1631, 1641 to securely connect the internal metal block 1631 to the component 275, and the internal metal block 1641 to the component 285.

The sign base 100 may utilize one or more of the gas springs 1600 interposed between pairs of adjacent telescopically connected components of the mast 200 to assist in extending the length of the mast 200 to raise the roadway safety sign 150. When locking knobs 295 (that are associated with the pairs of components between which gas springs are interposed) are loosened to permit each adjacent pair of telescopically connected components (such as the components 275, 285 shown in FIGS. 6, 10 and 17) to move relative to each other, the associated gas spring 1600 that is interposed between the paired components 275, 285 will store energy when the components 275, 285 retract (as the roadside safety sign 150 is lowered), and will release the stored energy when the components 275, 285 extend (as the roadside safety sign 150 is raised). By this arrangement, the energy stored by one or more of the gas springs 1600 during lowering of the sign 150 may be employed to assist one's efforts to raise the sign 150—which makes it easier for a single operator to raise the roadside safety sign 150 that is supported by the sign base 100.

Figure 5:
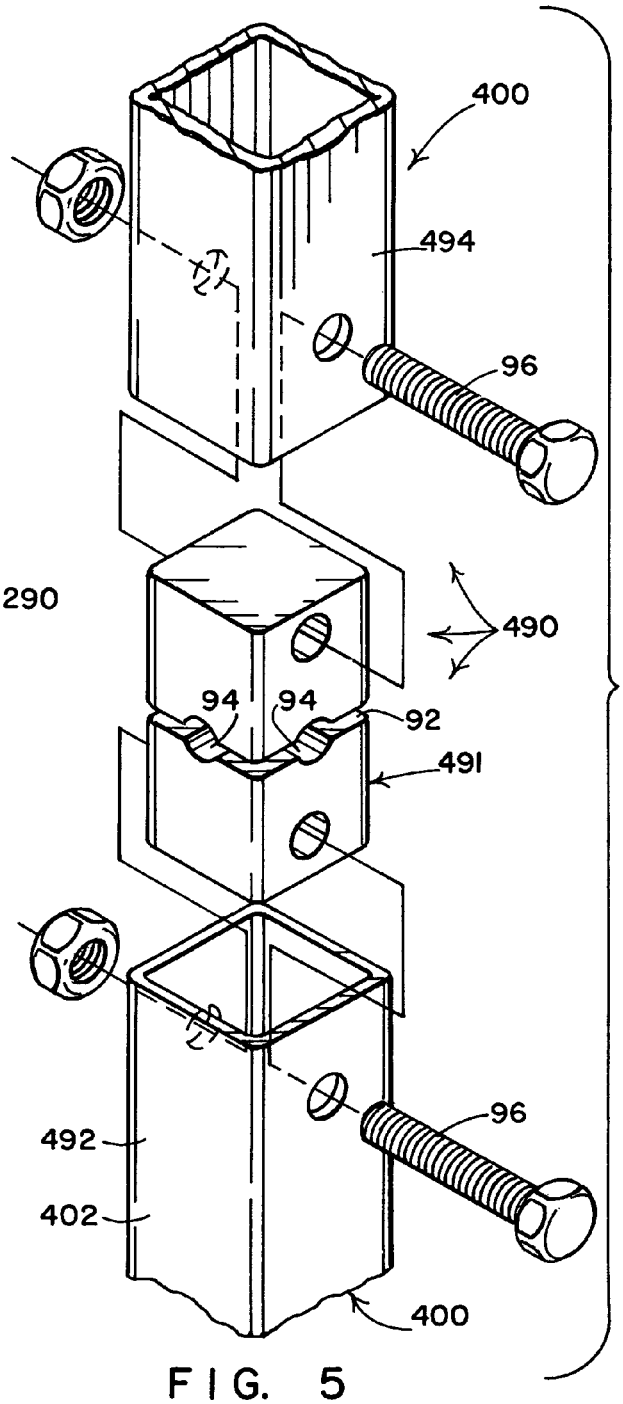
FIG. 5 is an exploded perspective view of components of another of the identical breakaway assemblies.

In preferred practice, the elongate metal blocks 1631, 1641 shown in FIG. 17 are of the same length as the breakaway blocks 291, 491 (one of which is shown in FIG. 5); and, in fact, the breakaway block 291 that is installed in the lower end region 202 of the mast 200 as a part of the breakaway assembly 290 (shown in FIG. 4) may be used to form one of the blocks 1631, 1641 to which one of the end regions 1610, 1620 of an internally positioned gas spring 1600 is connected—by which arrangement, a gas spring 1600 may be positioned internally of a lower part of the central region 204 of the mast 200 to cooperate with at least one other gas spring 1600 positioned internally of components of the mast 200 at a higher location between telescopically extensible/retractable components 275, 285 of the mast 200.

Where telescopically extensible and retractable components 275, 285 of the mast 200 are provided that enclose a gas spring 1600 (and are connected by internally carried metal blocks 1631, 1641 to opposite end regions 1610, 1620 of the enclosed gas spring 1600) in the manner depicted in FIG. 17, at least one locking knob 295 is carried by the component 285 of larger cross-section that can be tightened into engagement with the component 275 of smaller cross-section to retain these relatively movable components 275, 285 in selected extended and retracted positions in the same manner that the locking knob 295 is provided, as shown in FIG. 6, to retain the relatively movable, telescopically extensible and retractable mast components 275, 285 shown in FIG. 6.

Figure 13:
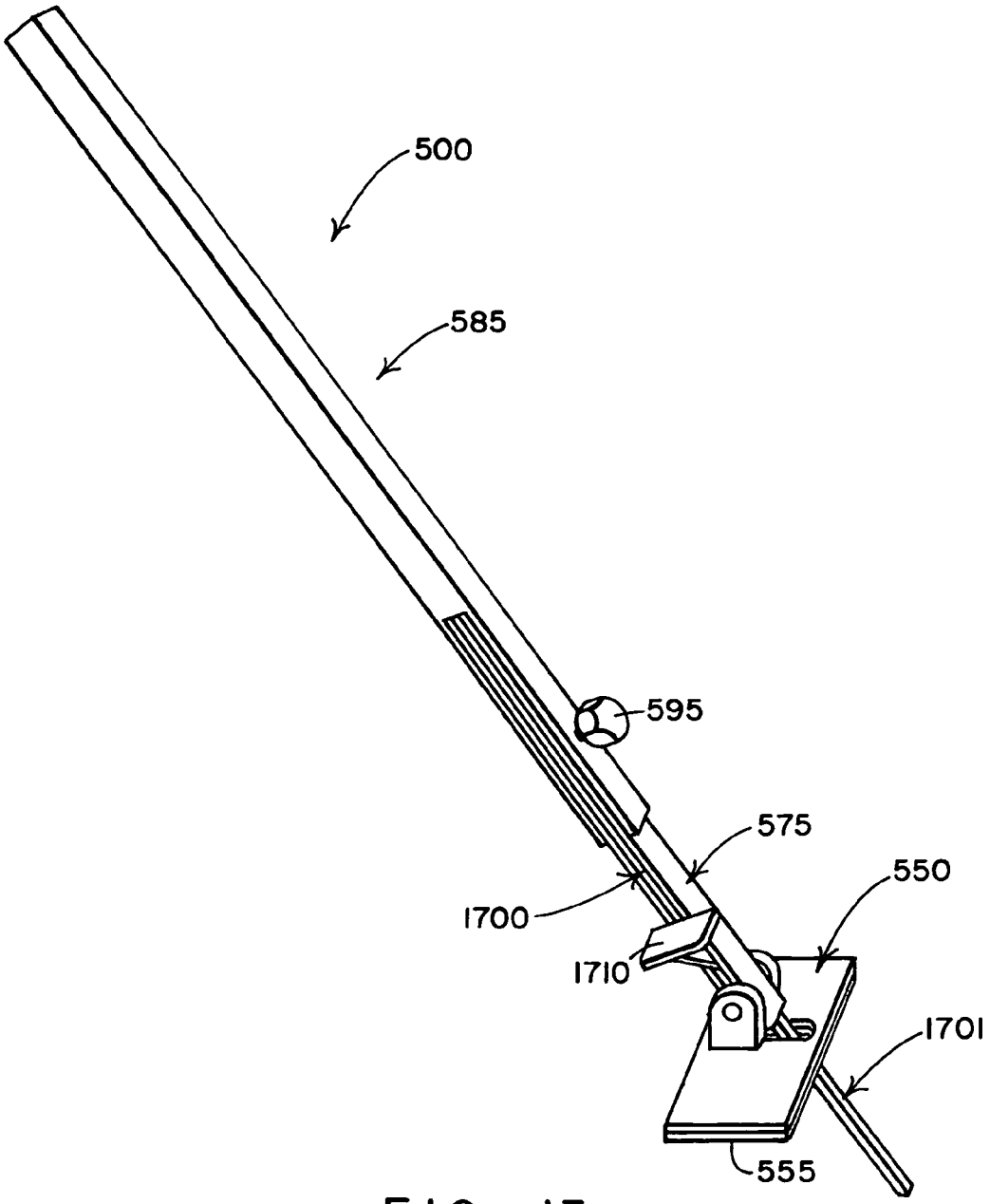
FIG. 13 is a perspective view showing a form of leg and foot assembly that may be used by the sign base and which carries a telescopically extensible and retractable spike member that is shown in an extended position.

To better assure that the sign base 100 is retained at a desired location atop the ground or support surface 50, one or more of the legs 500, 600, 700 may be replaced by an alternate leg assembly such as is shown in FIG. 13 and designated by the numeral 500. The alternate leg assembly 500 has telescopically connected upper and lower components 585, 575 that are open along one side to permit a horizontally extending element 1710 of a lengthy spike member 1700 (that is telescopically carried by the upper and lower leg assembly components 585, 575) to project through the open sides of the components 575, 585.

The horizontally extending element 1710 is intended to be engaged and forcefully depressed, for example by a shoe or boot of a person who is positioning and installing the sign base 100, to force a lower end region 1701 of the lengthy spike member 1700 to extend beneath the depicted foot 550 to penetrate a portion of the ground or support surface 50 that underlies the depicted foot 550. Or, the horizontally extending element 1710 may be impacted with hammer blows to force the lower end region 1701 to penetrate an underlying ground or support surface portion to thereby securely couple the alternate leg assembly 500 to the ground or support surface 50. Alternate leg assemblies 500 of the type shown in FIG. 13 may replace any or all of the type of leg assemblies or legs 500, 600, 700 that are depicted in FIGS. 1-3 to provide the sign base 100 with the capability of being securely coupled at a plurality of locations to the underlying ground or support surface 50.

Yet another way in which the feet 550, 650, 750 may be encouraged to securely grip and retain desired positions on the ground or support surface 50 is to provide them with resilient, support-surface-engaging rubber pads, such as the pad that is designated by the numeral 555 in FIG. 13. Indeed, resilient rubber pad material may be bonded to underside surface areas of any or all of the feet 550, 650, 750 to help retain the feet 550, 650, 750, and hence the sign base 100, in place at desired locations atop the ground or support surface 50. If the L-shaped front foot 350 does not need to extend into the open front end region of the front part 385 of the horizontally extending support member 300, the bottom surface of the horizontally extending part 351 of the L-shaped front foot 350 also may be provided with a resilient rubber pad such as is indicated by the numeral 555 in FIG. 13.

Other components of the sign base 100 that are shown in FIGS. 1-3 include a battery box 900 that is supported by the mast 200 at a location situated a short distance above the tray 800; an electrical control box 1000 that is connected to the central region 204 of the mast 200 at a location above where the upper end regions 506, 606, 706 of the legs 500, 600, 700, respectively, pivotally connect with the mast 200; a solar panel 1100 (see FIGS. 2, 3, 8 and 9) supported by the mast 200 at a location behind the sign 150; and a wiring harness 1200 that extends loosely along portions of the mast 200 to electrically interconnect the solar panel 1100 and the control box 1000 with a battery 950 (depicted schematically in the block diagram of FIG. 14) that preferably is carried inside the battery box 900.

Figure 7:
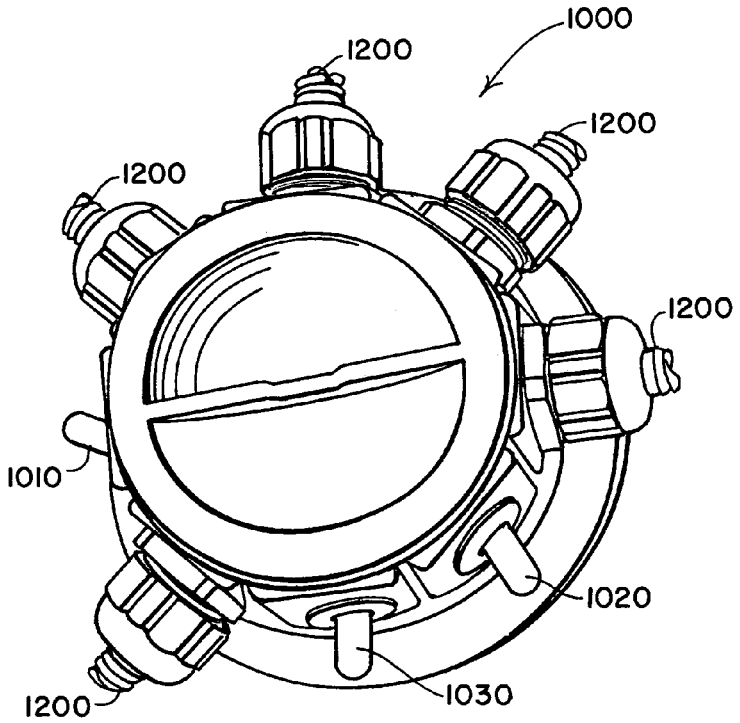
FIG. 7 is a view, on an enlarged scale, of one face of an electrical control box of the sign base.
Figure 8:
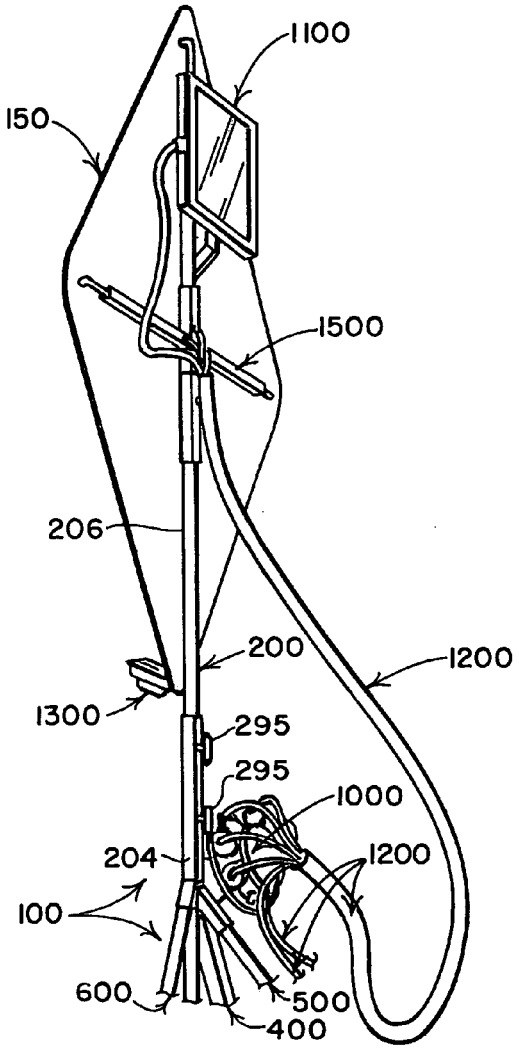
FIG. 8 is a perspective view on a diminished scale showing rear and right side features of a portion of the sign base supporting a partially raised sign, with a solar panel in a retracted position.
Figure 9:
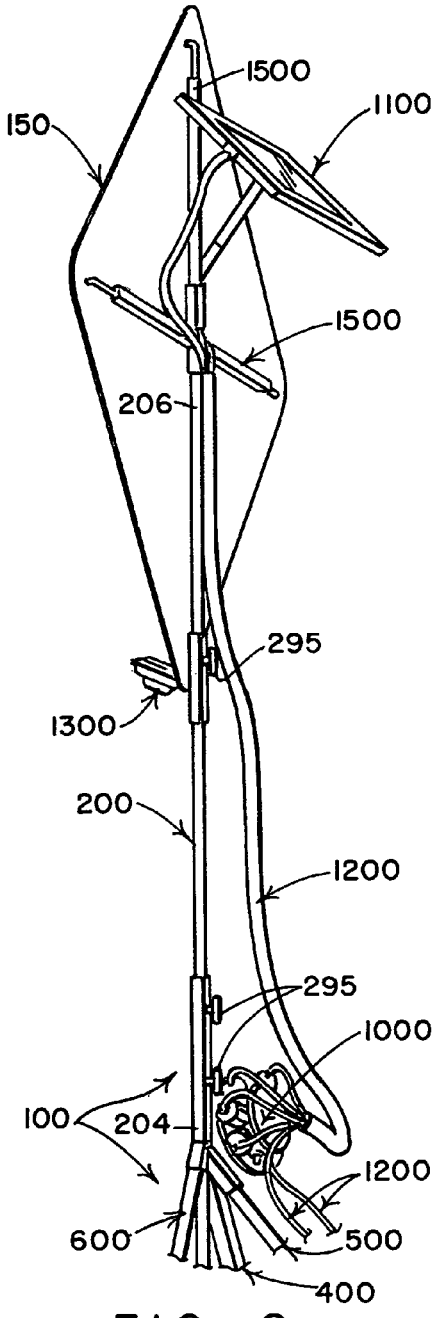
FIG. 9 is a perspective view similar to FIG. 8 with the sign in a fully raised position, and with the solar panel in an extended position.

Referring to FIG. 7, portions of the wiring harness 1200 can be seen to extend into and out of the control box 1000 at a variety of locations spaced about the perimeter of the control box 1000. Three switches 1010, 1020, 1030 that are carried by the control box 1000 are shown as providing manually operable control levers situated at spaced locations among the various locations where portions of the wiring harness 1200 extend into and out of the control box 1000. However, as those skilled in the art will readily appreciate, the switches 1010, 1020, 1030 may be replaced by push button switches, keyboard switches or any of a wide variety of other forms of conventional and commercially available switches and controls that may be electrically connected in other ways and at other locations to one or more conventional control boxes which may differ from the depicted control box 1000 to serve such functions as are served by the manually operable switches 1010, 1020, 1030.

Figure 14:
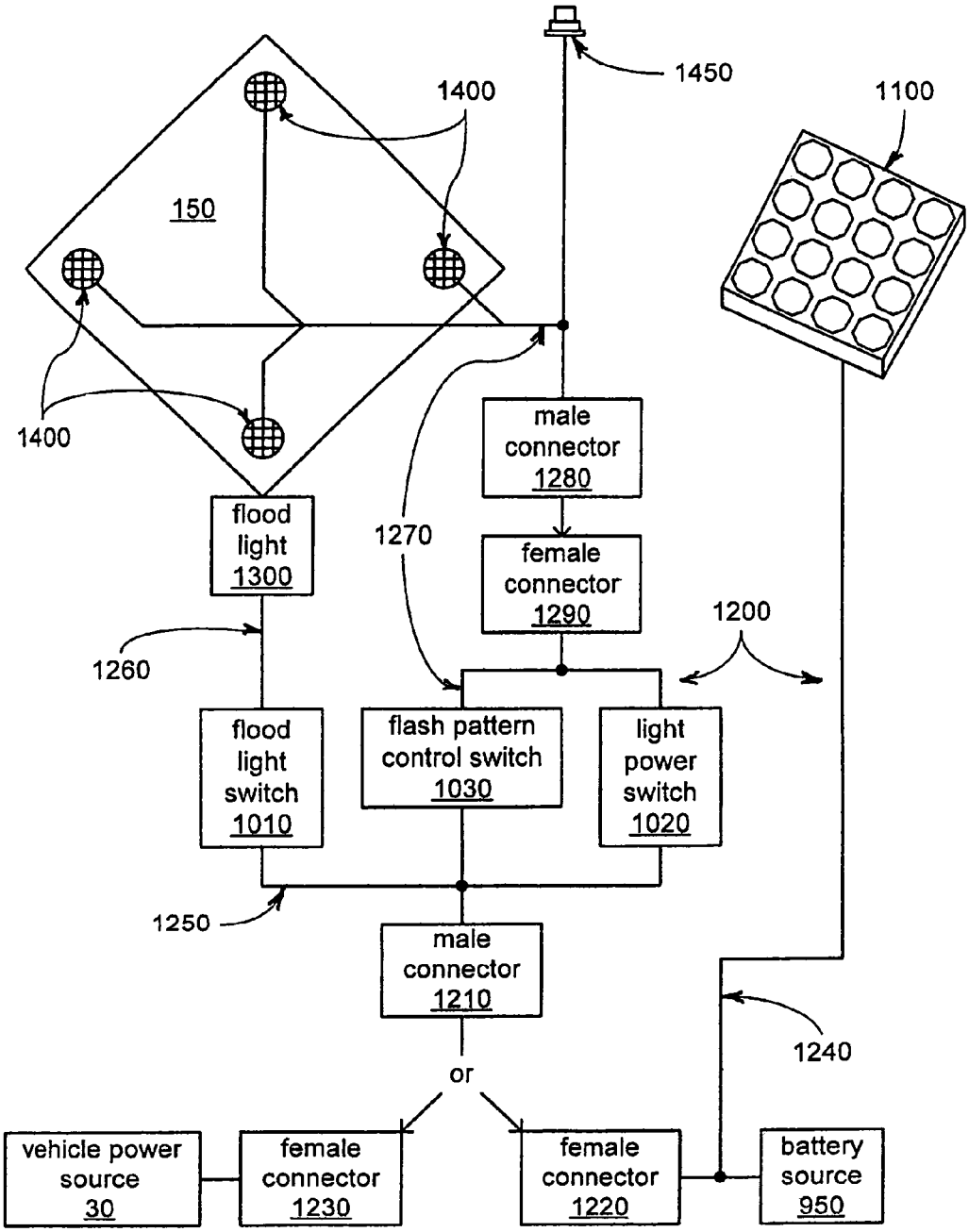
FIG. 14 is a simplified block diagram that depicts somewhat schematically how electrical components of the sign base and sign may be interconnected, controlled and powered selectively from a battery, a solar cell, and an electrical system of a vehicle.

Components that are shown in the accompanying drawings as being connected to the sign 150 (but alternatively may be carried by other elements such as brackets, not shown, that may be connected to the mast 200) include a floodlight 1300 positioned beneath or near to the lowest part of the sign 150 and aimed upwardly for illuminating the front face of the sign 150 (see FIGS. 1, 8 and 9), and one or more attention attracting strobe lights 1400 that are shown in FIGS. 1, 14 and 30 near the four corner regions of the depicted square or diamond-shaped signs 150 that are shown in these views.

To reach the locations of such strobe lights 1400 as may be carried by one of the interchangeable signs 150 (such as is shown in FIGS. 1-3, 8, 9, 12 and 14) or by a sign assembly 175 (such as is shown in FIGS. 30 and 31), portions of the wiring harness 1200 may be ducted through various tubular components such as are designated generally by the numeral 1500 in FIG. 16. The tubular components 1500 include leftwardly extending, rightwardly extending, and upwardly extending central components 1585 that are telescopically connected to left, right and top components 1575 that are adjustably held in place by knob operated fasteners 1595 of the same type indicated by the numeral 295 in FIG. 6.

Alternatively, portions of the wiring harness 1200 that electrically connect with lights that may be carried by one of the interchangeable signs 150 or by the sign assembly 175 may be protectively shielded as they extend across rear surface portions of an associated sign 150 by an appropriately configured housing, such as the double-arrow-shaped housing 1425 that is shown in FIG. 31. The housing 1425 is of sufficient size to enclose rear portions of a set of so-called "sequence lights" 1475 (FIG. 30) that form elements of the sign assembly 175. The sequence lights 1475 may be illuminated in selected sequences to form arrows to direct approaching traffic to the right or to the left of a site where the sign assembly 175 is displayed.

Referring to FIG. 14, a plurality of waterproof electrical connectors 1210, 1220, 1230, and a plurality of sets of electrical conductors 1240, 1250, 1260, 1270 may form elements of the wiring harness 1200. The just-mentioned connectors include a male connector 1210 that can mate with and electrically interconnect with either of 1) a female connector 1220 powered by the battery 950 and/or by the solar panel 1100, and 2) a female connector 1230 powered by an electrical system 30 of a vehicle, such as the pickup truck 25 shown in FIG. 12.

The conductor sets that are included in the wiring harness 1200 include a set of conductors 1240 that electrically connect the solar panel 1100, the battery 950 and the female connector 1220; a set of conductors 1250 that deliver power from the male connector 1210 to the control box 1000; a set of conductors 1260 that deliver power from a switch 1010 of the control box 1000 to the floodlight 1300; and a set of conductors 1270 that deliver power and signals that originate from the switches 1020, 1030 of the control box 1000 to the strobe lights 1400 to cause the strobe lights 1400 to flash in desired sequences selected to attract attention.

To permit a variety of roadway safety signs 150 that may carry portions of the wiring harness 1200 to be connected to other portions of the wiring harness 1200 that are carried by the multipurpose sign base 100, waterproof male and female connectors designed to electrically connect one with the other may be interposed where needed at various locations along the lengths of the conductors of the wiring harness 1200. For example, as is shown in FIG. 14, waterproof male and female connectors 1280, 1290 may be interposed in the conductors 1270 so that upper portions of the conductors 1270 that may be carried by the depicted sign 150 can be releasably coupled to lower portions of the conductors 1270 that are carried by the sign base 100. In FIG. 31, for example, male connectors 1280 are shown connected to conductors 1270 that comprise elements of the sign assembly 175, thereby permitting the depicted sign assembly 175 to be interchanged with other similar sign assemblies (not shown) that carry similar male connectors 1280 which can be connected to one or more female connectors 1290 (FIG. 14) carried by portions of the wiring harness 1200 of the multipurpose sign base 100.

Referring to FIG. 7, the switches 1010, 1020, 1030 have operating levers (or other graspable or finger engageable operating elements such as buttons, not shown) that are provided for manual operation. When the switch 1010 is operated to supply power through the set of conductors 1260 (FIG. 14) to the floodlight 1300, this causes the floodlight 1300 to illuminate the front face of the sign 150. When the switch 1020 is operated to supply power through the set of conductors 1270 (FIG. 14) to the strobe lights 1400, and when the switch 1030 is operated to send signals through the set of conductors 1270 (FIG. 14) to the strobe lights 1400 to select from among a variety of flashing sequences offered by the strobe lights 1400, the strobe lights 1400 flash in a selected sequence to draw attention to the sign 150.

When the sign base 100 and one of the roadway safety signs 150 are utilized at night, the floodlight 1300 is powered to illuminate the front face of the sign 150, and the strobe lights 1400 are powered to display a selected sequence of light flashes intended to help approaching motorists understand information intended to be conveyed by printing, traffic symbols and/or the like carried on the front face of the sign 150, such as information telling motorists that they are nearing a construction site or other danger zone where special driving precautions are likely to be needed to ensure the safety of road workers and other personnel who may be present at locations near where the motorists are likely to drive as they travel through such zones and sites.

There is yet another component that may be desirably carried by the multipurpose sign base 100 to further help, especially in foggy conditions and at night, to draw the attention of approaching motorists to the presence of, and to the messages provided by, such signs 150 as may be interchangeably carried by the sign base 100. The added component is a rotating or flashing beacon light 1450, such as is shown in FIGS. 14, 30 and 31. The beacon light 1450 preferably is mounted atop the mast 200 (as shown in FIGS. 30 and 31) to define the highest component of the multipurpose sign base 100, and should have the capability to project flashing light over the top of any roadway safety sign 150 that is carried by the multipurpose sign base 100. As is shown in FIG. 14, the set of conductors designated by the numeral 1270 that form components of the wiring harness 1200 may be utilized to provide electrical power to operate the beacon light 1450 when desired; and, as those skilled in the art will readily understand, the control box 1000 may be provided with switches or other controls (not shown) for operating the beacon light 1450.

Referring to FIG. 12, to enhance the ease with which the multipurpose sign base 100 can be moved about at a site where the sign 150 is to be displayed by the base 100, a dual-handle element 225 preferably is added to the central region 204 of the mast 200 at a location just beneath where the sign 150 resides when the mast 200 is retracted to position the sign 150 at its lowest position on the multipurpose sign base 100. The dual-handle element 225 is formed from a length of steel rod stock that is bent to form a generally square, substantially endless loop having four smoothly rounded corners that connect a pair of parallel-extending left and right upright portions 226 with parallel-extending top and bottom portions 227. The top and bottom portions 227 extend substantially horizontally, and are welded mid-way along their lengths to a front surface of the central region 204 of the mast 200.

What the dual-handle element 225 provides are left and right handles located on left and right sides, respectively, of the mast 200—left and right handles that are located where road workers can conveniently grasp the multipurpose sign base 100 at the heart of its supporting framework—essentially at a center of mass of much of the framework of the base 100, which facilitates moving the base 100 about as the sign 150, supported by the base 100, is moved into and out of positions where the sign 150 needs to be displayed.

Referring to FIG. 16, the upper end region 206 of the mast 200 optionally may be provided with a U-shaped double handle member formed from a length of rod stock that has been bent to define curved left and right handles 1525 that extend from opposite sides of the upper end region 206 of the mast 200 to connect with the upper end region 206 of the mast 200, and with the two of the components 1585 that project away from the upper end region 206 of the mast 200 in opposite directions. The handles 1525 provide graspable formations (in addition to other handles that may be provided at various locations on the sign base 100 and on the sign 150 or sign assembly 175, such as the handles 825 that are shown in FIGS. 1-3, 11 and 12, and the handles 1525 that are shown in FIGS. 16 and 31) which can be grasped when the multipurpose sign base 100 (often with a sign 150 or with the sign assembly 175 carried thereon) needs to be moved from one location to another.

Insofar as the sign assembly 175 shown in FIG. 31 is concerned, the left and right handles 1525 as well as the components to which they are attached may form elements of the sign assembly 175, and of similar sign assemblies (not shown) that can be interchangeably installed atop the mast 200 of the sign base 100.

To make it easier for the multipurpose sign base 100 to be moved about on a support surface such as is indicated by the numeral 50 in FIGS. 1-3, optional front and rear wheel-carrying dollies may be provided for connection to front and rear end regions of the horizontally extending support member 300, or for connection to the front and rear extension components 375, 380, respectively.

Figure 19:
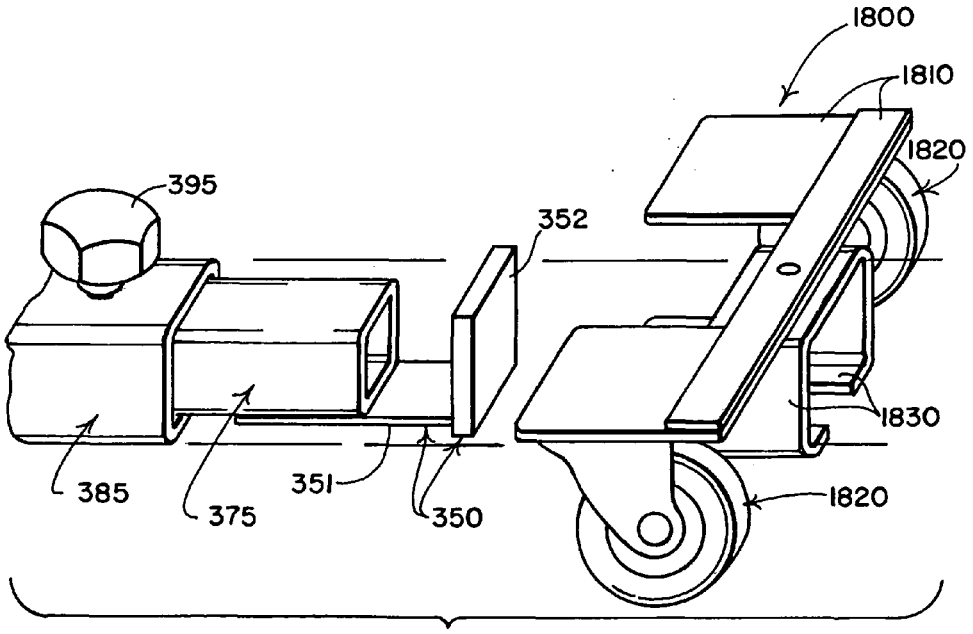
FIG. 19 is a perspective view of the front portion of the horizontally extending support member with a front extension component and the L-shaped front leg extended from within the front portion of the horizontally extending support member where portions of these members nest when in their retracted positions.

A preferred form of optional front dolly is depicted in FIGS. 18 and 19, and is designated generally by the numeral 1800. A preferred form of optional rear dolly is depicted in FIGS. 26 and 27, and is designated generally by the numeral 1900. The front dolly 1800 is shown connected to the forwardly projecting portion 385 of the horizontally extending support member 300 in FIG. 18. The rear dolly 1900 is shown connected to the enlarged end region 381 of the rear extension component 380 in FIG. 26.

Referring to FIGS. 18 and 19, the front dolly 1800 has a welded supporting framework 1810 that preferably carries a pair of conventional, commercially available, multidirectional casters 1820. In FIG. 18, the front dolly 1800 is shown installed on the forwardly projecting portion 385 of the horizontal support member 300. In FIG. 19, the front dolly is shown separated from the forwardly extending portion 385 and from the front extension component 375.

A supporting framework 1810 of the removable front dolly 1800 includes a tubular member 1830 that is configured to slide over the front foot 350, over the front extension component 375, and onto the forwardly projecting tubular portion 385 of the horizontal support member 300. The same knob-operated locking bolt 395 shown in FIGS. 1-3, 18 and 19 that holds the front extension component 375 in its extended and retracted positions is used to releasably retain the front dolly 1800 in place on the tubular front portion 385 of the horizontal support member 300. The casters 1820 are spaced equidistantly from left and right sides of the front portion 385, and depend beneath the bottom of the tubular portion 385 to cause the forwardly extending front portion 385 of the horizontally extending support member 300 to be raised a short distance above an underlying support surface 50 atop which the multipurpose sign base 100 is positioned.

Referring to FIGS. 26 and 27, the rear dolly 1900 has a tubular framework 1910 that preferably carries a pair of left and right wheels 1920. The tubular framework 1910 is configured to enable it to slide freely onto the enlarged end region 381 of the rear extension component 380 (or onto the rearwardly extending portion 320 of the horizontally extending support member 300) where it can be secured by the hitch pin 35 and spring clip 36 that are shown in FIG. 27, with the pin 35 extending through aligned holes 1930, 382 formed through the framework 1910 and the enlarged end region 381, respectively. The wheels 1920 depend below the bottom of the tubular framework 1910 and cause the rearwardly extending portion 320 of the horizontally extending support member 300 to be raised a short distance above an underlying support surface 50 atop which the multipurpose sign base 100 is positioned.

The various roadway safety signs 150 that are supported by the multipurpose sign base 100 may be formed from a wide variety of materials, as is well known in the art. For many years, the roadway safety signs 150 have been formed from sheets of metal that are coated to resist the elements of weather including sunlight that can fade such messages as are intended to be conveyed by the signs 150. Metal roadway safety signs 150 of this type typically are mounted on components of the sign base 100 (such as are indicated by the numerals 206, 1585 and 1575 in FIGS. 2, 3 and 16) by inserting screw or bolt type threaded fasteners (not shown) through holes (not shown) formed through the signs 150, and by tightening the inserted fasteners into threaded openings (not shown) defined by sign base components such as are indicated in FIGS. 2, 3 and 16 by the numerals 206, 1585 and 1575. Some of these metal signs 150 may be provided with other openings (not shown) so air can flow through the signs 150 to diminish their resistance to wind, and to thereby diminish the wind load the signs 150 impose on their supporting bases 100.

More recently, various roadway safety signs 150 have been formed from fabric that significantly lightens the weight that must be supported by sign bases 100. Many of these fabric signs (not shown) are formed from Nylon mesh or other similar synthetic fabric materials designed to permit air flow therethrough, to diminish the wind load to which supporting sign bases are subjected. Many of these fabric safety signs have pockets, channels or compartments that carry relatively lightweight framework components formed from minimally bendable plastics material or from strips of metal (not shown), so that the resulting roadway safety signs 150 are indeed formed primarily of fabric and are referred to as "fabric safety signs," but they behave very much like, if not substantially the same as, roadway safety signs 150 that are formed entirely from metal. Moreover, many of these so-called "fabric safety signs" also are provided with pockets, channels, compartments or ducts (not shown) that are designed to not only carry electrical wiring harness connectors and conductors, but also to operably support electrically powered lights of substantially the same type as are typically are carried by roadway safety signs that are formed entirely from metal, as described earlier herein.

Because many fabric roadway safety signs that currently are in use have appearances that are so nearly identical to their earlier metal counterparts as to be substantially indistinguishable therefrom at any appreciable distance, and because many of these fabric safety signs carry their own frameworks thereby causing them to behave with substantially the same characteristics as their metal counterparts, it is appropriate to consider the use that is made in the accompanying drawings of the reference numeral 150 to refer interchangeably to fabric and metal roadway safety signs.

To ensure that the multipurpose sign base 100 is well suited to support roadway safety signs 150 formed from a wide variety of materials including metal and fabric, such sign base components as are designated by the numerals 206 and 1575 in FIGS. 2, 3 and 16 preferably are provided with threaded holes (not shown) on a front or rear face thereof for receiving conventional threaded fasteners (not shown) that, as discussed above, may extend through holes formed through metal safety signs 150 to mount the metal safety signs 150 on the mast 200 and crossbar components 1585, 1575, and are provided with appropriately configured brackets, hooks or other fasteners (not shown) on their opposite front or rear faces for engaging and supporting roadway safety signs 150 made primarily from fabric materials. Depending on which type of safety sign 150 is to be supported, these double-sided, dual-functional components 206, 1575 may be turned one way to provide threaded screw holes to receive threaded fasteners for supporting an interchangeable set of metal safety signs 150 on the sign base 100, or may be reversed to present a set of ready-to-use brackets, hooks or other suitable fasteners that are designed to support an interchangeable set of fabric safety signs 150 on the sign base 100. The type of sign support brackets, hooks or other fasteners that may be carried on such components as are designated by the numerals 206, 1575 will, of course, vary, depending on how the fabric safety signs 150 that need to be supported are configured.

As those who are skilled in the art will readily appreciate, there are basic additions that should be made to the multipurpose sign base 100 to take into account how it will be used. Lights (not shown) should be carried by the sign base 100 that augment the lights of a vehicle to which the sign base is attached, if the sign base 100 is found to block the view of any of the rear lights of the vehicle; and a conventional set of safety chains (not shown) should be welded to the horizontally extending support member 300 or to the brace 400 for connection to the hitch of a vehicle that is used to support the sign base 100 when the sign base 100 is to be vehicle transported in other than off-road settings. Other similar safety precautions will be obvious to those skilled in the art.

In one aspect, sign bases 100 embodying certain features of the present invention have at their heart a rigid triangular support structure formed by the assembly of the mast 200, the horizontally extending support member 300, and the brace 400 that provide a degree of strength and structural integrity significantly greater than has been offered by prior sign base proposals.

In another aspect, sign bases 100 that embody certain features of the present invention utilize breakaway assemblies 290, 490 of a simple but effective type that, when severed due to less than devastating impact, often permit an impacted sign base to be returned quickly and easily to service simply by unbolting and replacing the severed components of the breakaway assemblies.

In another aspect, sign bases 100 that embody certain features of the present invention provide an array of graspable formations such as the handles 226 (FIG. 12), the handles 825 (FIGS. 11 and 12) and the handles 1525 (FIG. 16) that may be used together with the removable front and rear dollies 1800, 1900 to easily move the sign bases 100 (and the signs 150 or the sign assemblies 175 they support) from place to place on support surfaces 50 such as are depicted in FIGS. 1-3.

In another aspect, sign bases 100 that embody certain features of the invention may include one more of the gas springs 1600 (FIGS. 10 and 17) which may be externally bracket-connected to, or protectively enclosed within, telescopically connected mast components 275, 285 such as are shown in FIGS. 10 and 17, respectively, to utilize energy that the gas springs 1600 store during lowering of a supported safety sign 150 or sign assembly 175 to a retracted position, to assist with its next raising to an extended position.

In another aspect of the invention, sign bases 100 that embody certain features of the invention are equally usable with metal or fabric safety signs 150.

In yet another aspect of the invention, sign bases 100 that embody certain features of the invention include horizontally extending support members that preferably serve a plurality of functions ranging from complementing the leg-carried feet 550, 650, 750 as ground-surface-engaging elements, to providing support for front and rear extension components 375, 380, to being hitch-housing-insertable in ways that permit the sign bases 100 to be supported on a vehicle's hitch housing, or on leg-carried feet that are selectively arrayed about the upstanding mast of the sign base 100.

As those skilled in the art will readily appreciate, the fact that the "sign bases" that are disclosed herein are particularly well suited for use with roadway safety signs 150 does not limit their use to supporting roadway safety signs, or to supporting "signs" of any description. Indeed, the disclosed "sign bases" may be put to use supporting a wide variety of equipment and other devices that preferably are supported temporarily and at above-ground levels for a wide variety of reasons, and for performing a wide variety of functions. Weather sampling and environmental testing and recordal equipment, portable lights, temporary traffic signals, outdoor speakers, temporary solar cells and windmills, and a great many other types and kinds of apparatus can, of course, be satisfactorily supported by the sign base units disclosed herein.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the claims which follow protect such patentable features as exist in the disclosed invention.

What is claimed is:

1. A multipurpose sign base for supporting a roadway safety sign comprising an upstanding mast having at least an upper mast component and a lower mast component that are telescopically extensible and retractable, and that have a gas spring interposed therebetween to aid in raising the upper mast member relative to the lower mast member by releasing energy stored by the gas spring during lowering of the upper mast member relatively to the lower mast member; an elongate ground surface engageable horizontally extending support member rigidly connected to the lower mast component at a right angle to extend toward a hitch member of a vehicle; and a diagonal brace having a lower end rigidly connected to the elongate ground surface engageable support member and an upper end rigidly connected to the lower mast component, with a right triangle being defined between portions of the lower mast member, the ground surface engageable support member, and the diagonal brace, and with structurally weakened breakaway connections being provided in the diagonal brace and the lower mast member at locations near the ground engageable support member.

2. The multipurpose sign base of claim 1 wherein the gas spring is carried within and is protectively enclosed by the upper and lower mast components.

3. The multipurpose sign base of claim 1 additionally including a first wheel-carrying dolly removably connectable to an end region of the elongate, ground surface engageable support member to facilitate moving the sign base about atop a support surface.

4. The multipurpose sign base of claim 3 including a second wheel-carrying dolly removably connectable to an opposite end region of the elongate, ground surface engageable member to facilitate moving the sign base about atop the support surface.

5. The multipurpose sign base of claim 1 additionally including a set of lights connected to a roadway safety sign supported by the upper mast component, a battery supported by the lower mast component and operable to power the lights, and a solar cell supported by the mast and operable to charge the battery.

6. The multipurpose sign base of claim 5 additionally including a wiring harness connectable alternatively to an electrical system of a vehicle and to the battery for selectively powering the lights from the battery and from the electrical system of the vehicle.

7. The multipurpose sign base of claim 5 additionally including a switch operable to select from among a variety of differing sequences for flashing at least selected ones of the lights.

* * * * *